US012729513B2

(12) United States Patent
Abe et al.

(10) Patent No.: US 12,729,513 B2
(45) Date of Patent: Sep. 8, 2026

(54) WORK MACHINE

(71) Applicant: Hitachi Construction Machinery Co., Ltd., Tokyo (JP)

(72) Inventors: Kota Abe, Tsuchiura (JP); Teruki Igarashi, Tsuchiura (JP); Akihiro Narazaki, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 19/110,621

(22) PCT Filed: Sep. 21, 2023

(86) PCT No.: PCT/JP2023/034378
§ 371 (c)(1),
(2) Date: Mar. 11, 2025

(87) PCT Pub. No.: WO2024/070905
PCT Pub. Date: Apr. 4, 2024

(65) Prior Publication Data

US 2026/0092431 A1 Apr. 2, 2026

(30) Foreign Application Priority Data

Sep. 30, 2022 (JP) ..... 2022-158978

(51) Int. Cl.
*E02F 9/22* (2006.01)
*E02F 3/32* (2006.01)
(Continued)

(52) U.S. Cl.
CPC ..... *E02F 9/2203* (2013.01); *E02F 3/32* (2013.01); *E02F 3/437* (2013.01); *E02F 9/2242* (2013.01);
(Continued)

(58) Field of Classification Search
CPC . E02F 3/32; E02F 3/437; E02F 9/2203; E02F 9/2239; E02F 9/2242; F15B 11/04;
(Continued)

(56) References Cited

U.S. PATENT DOCUMENTS 7,066,446 B2 * 6/2006 Nielsen ..... F15B 11/042 251/324
10,400,426 B2 * 9/2019 Yamashita ..... F15B 11/04
(Continued)

FOREIGN PATENT DOCUMENTS

JP 2020-153461 A 9/2020
JP 2021-152307 A 9/2021
(Continued)

OTHER PUBLICATIONS

International Search Report (PCT/ISA/210) issued in PCT Application No. PCT/JP2023/034378 dated Oct. 31, 2023, with English translation (5 pages).
(Continued)

*Primary Examiner* — Michael Leslie
(74) *Attorney, Agent, or Firm* — Crowell & Moring LLP

(57) ABSTRACT

The present invention aims to provide a work machine capable of performing tasks with high precision by preventing the deterioration of speed responsiveness of the hydraulic cylinder driving the working device, as well as preventing the hydraulic cylinder from surging or deviating. To achieve this, the controller calculates the correction value for the target operating pressure of the flow control valve to keep the meter-out pressure of the hydraulic cylinder, measured while driving the hydraulic cylinder to perform a predetermined operation on the working device, within a range from a predetermined first lower limit to a predetermined first upper limit, and corrects the target operating pressure according to the correction value.

8 Claims, 21 Drawing Sheets

(51) Int. Cl.
*E02F 3/43* (2006.01)
*E02F 9/26* (2006.01)

(52) U.S. Cl.
CPC ..... *E02F 9/2296* (2013.01); *E02F 9/262* (2013.01); *E02F 9/2285* (2013.01); *E02F 9/2292* (2013.01)

(58) Field of Classification Search
CPC ..... F15B 11/044; F15B 11/046; F15B 11/17; F15B 2211/353; F15B 2211/633; F15B 2211/6343
See application file for complete search history.

(56) References Cited

U.S. PATENT DOCUMENTS

| | | | | |
|---|---|---|---|---|
| 10,801,524 | B2 * | 10/2020 | Nakano | E02F 9/2285 |
| 12,241,229 | B2 * | 3/2025 | Itsuji | F15B 13/02 |
| 12,371,873 | B2 * | 7/2025 | Kumagai | F15B 11/044 |
| 12,371,881 | B2 * | 7/2025 | Igarashi | F15B 11/042 |
| 12,454,806 | B2 * | 10/2025 | Igarashi | E02F 9/2029 |
| 2016/0138240 | A1 | 5/2016 | Ikegami et al. | |
| 2021/0348366 | A1 | 11/2021 | Ogura et al. | |
| 2022/0145580 | A1 | 5/2022 | Igarashi et al. | |
| 2023/0304262 | A1 | 9/2023 | Akita et al. | |

FOREIGN PATENT DOCUMENTS

| | | | |
|---|---|---|---|
| WO | WO 2015/137525 | A1 | 9/2015 |
| WO | WO 2021/065384 | A1 | 4/2021 |
| WO | WO 2022/137872 | A1 | 6/2022 |

OTHER PUBLICATIONS

Japanese-language Written Opinion (PCT/ISA/237) issued in PCT Application No. PCT/JP2023/034378 dated Oct. 32, 2023, with English translation (6 pages).
International Preliminary Report on Patentability (PCT/IB/338 & PCT/IB/373) issued in PCT Application No. PCT/JP2023/034378 dated April 10, 2025, including English translation of Written Opinion (PCT/ISA/237) (5 pages).

* cited by examiner

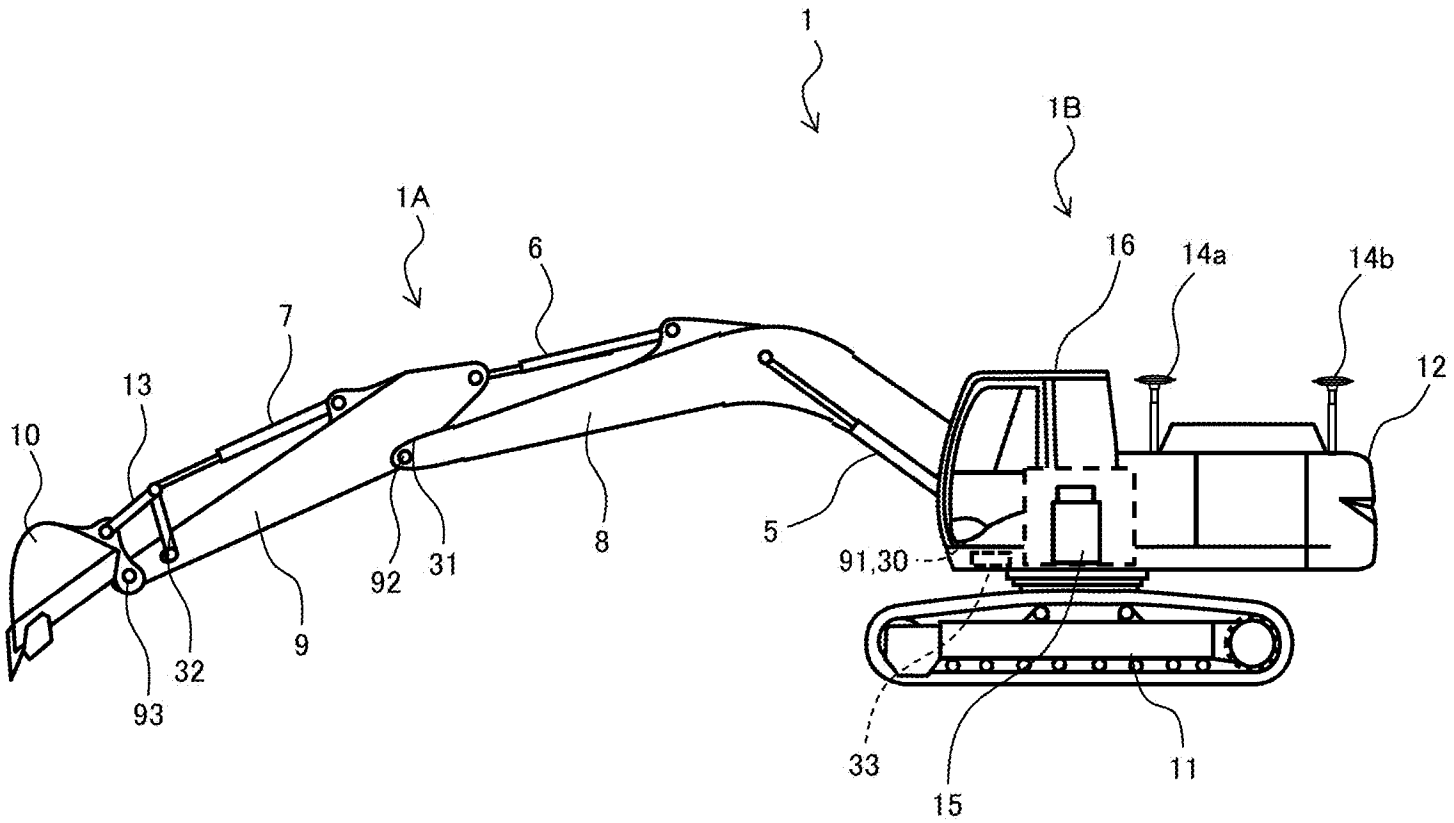
[FIG. 1]

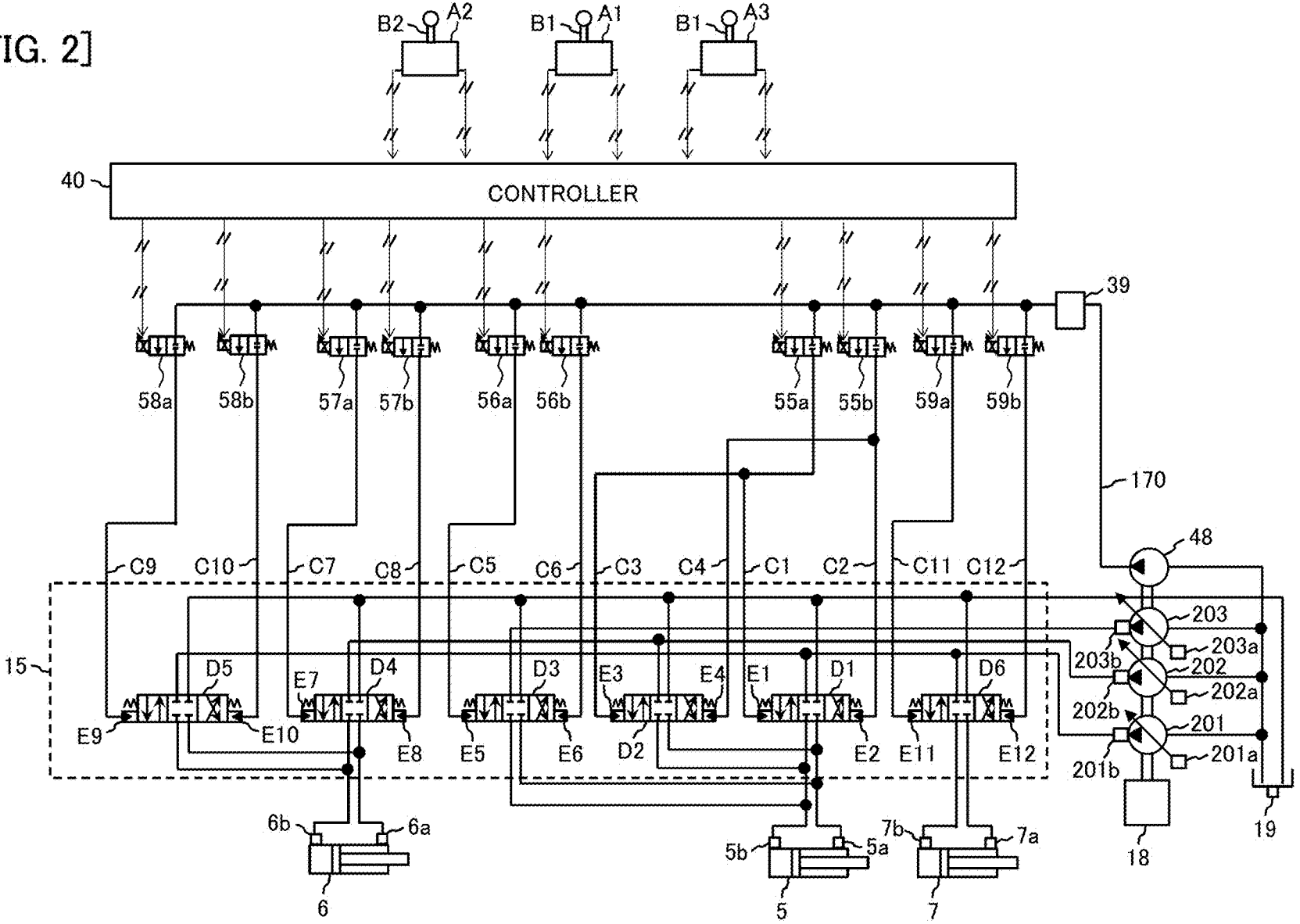
[FIG. 2]

[FIG. 3]
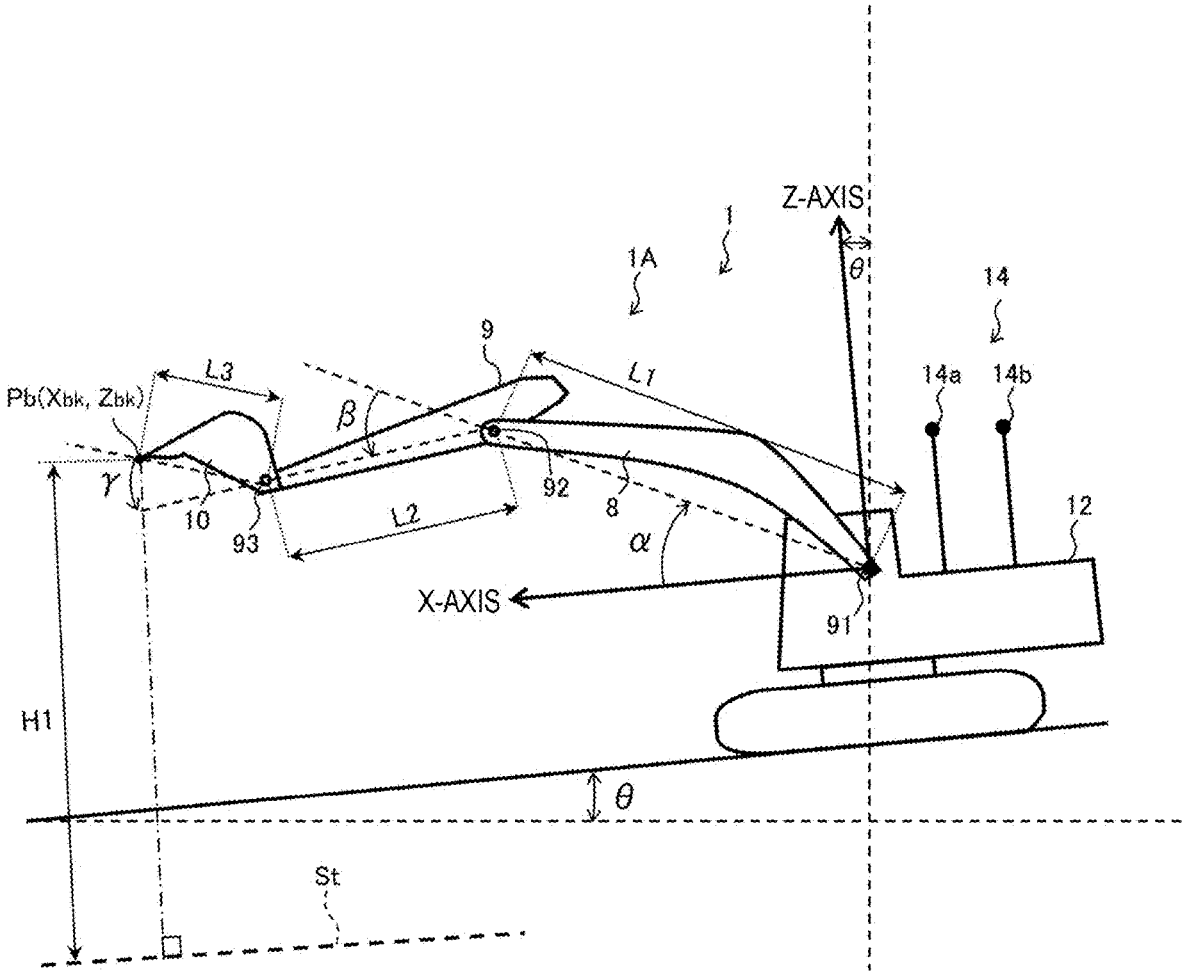

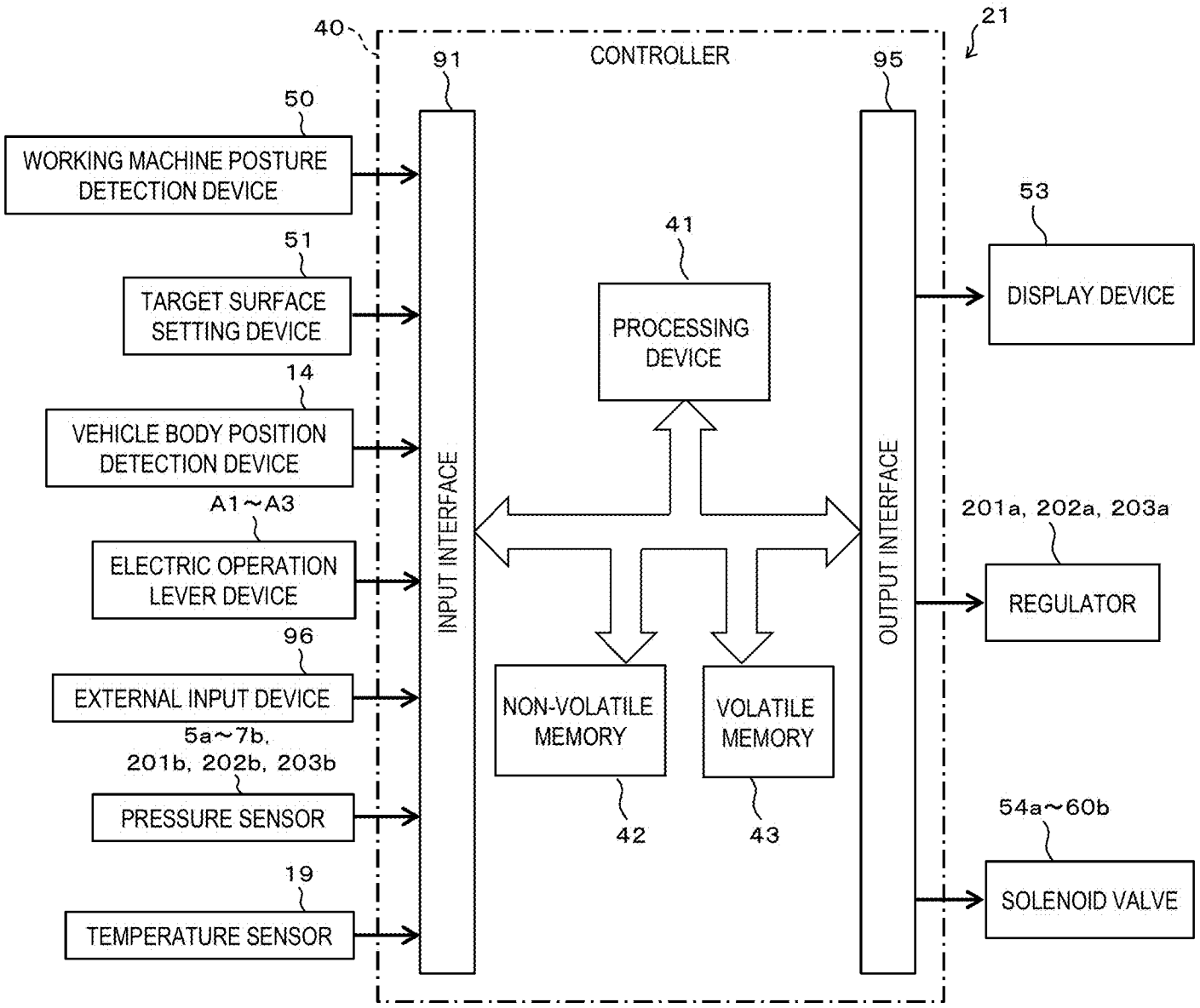
[FIG. 4]

[FIG. 5]
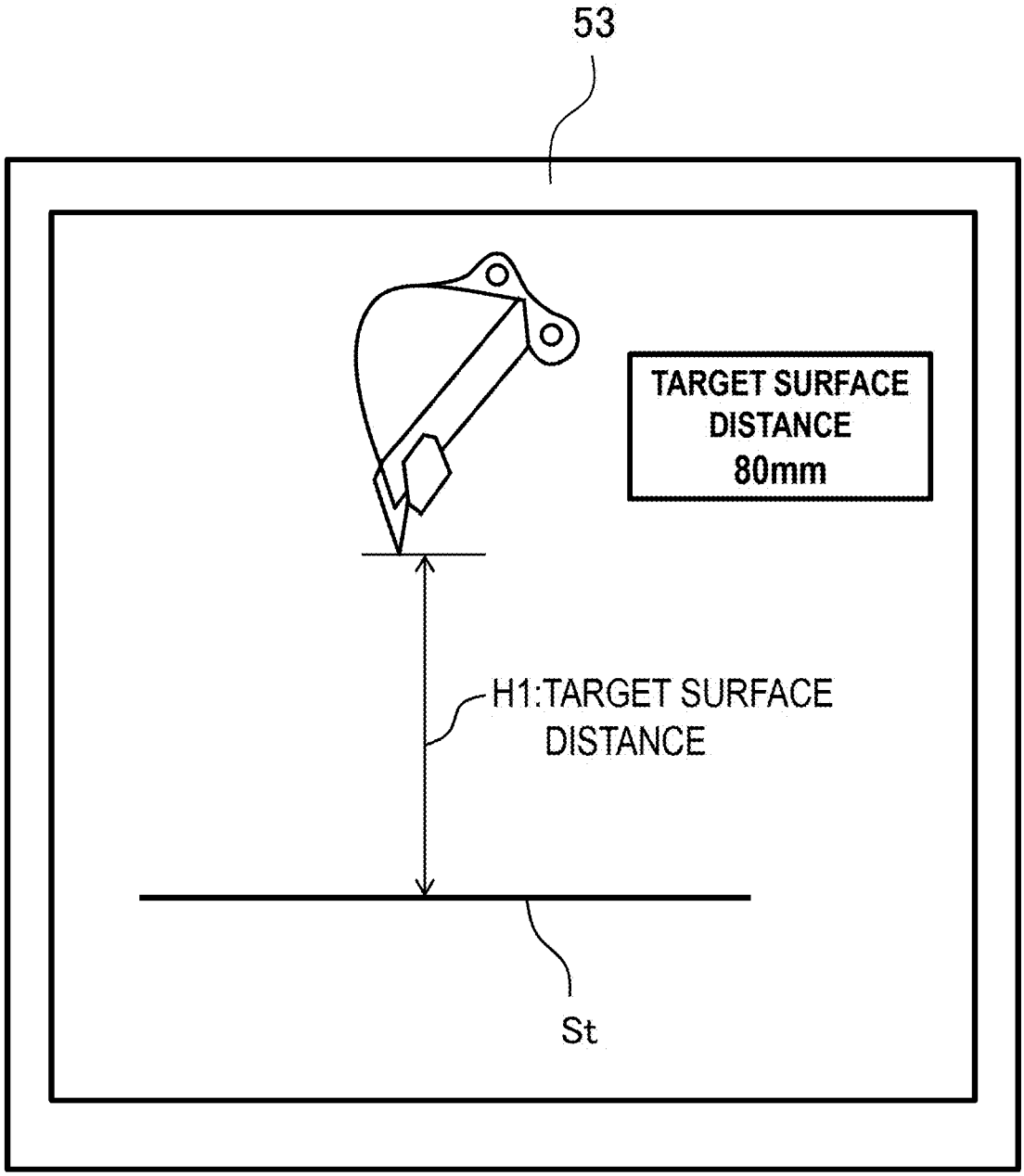

[FIG. 6]
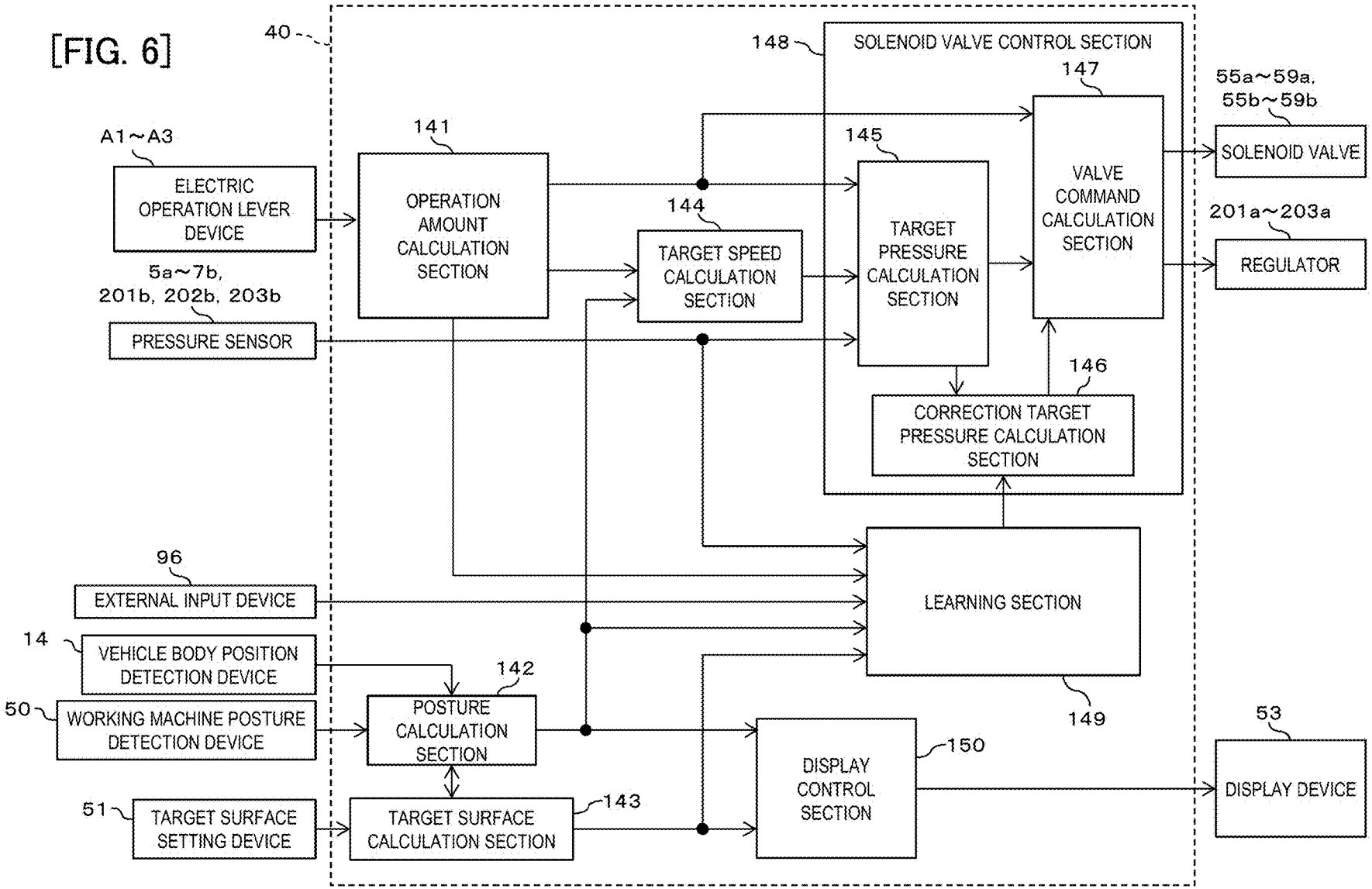

[FIG. 7]
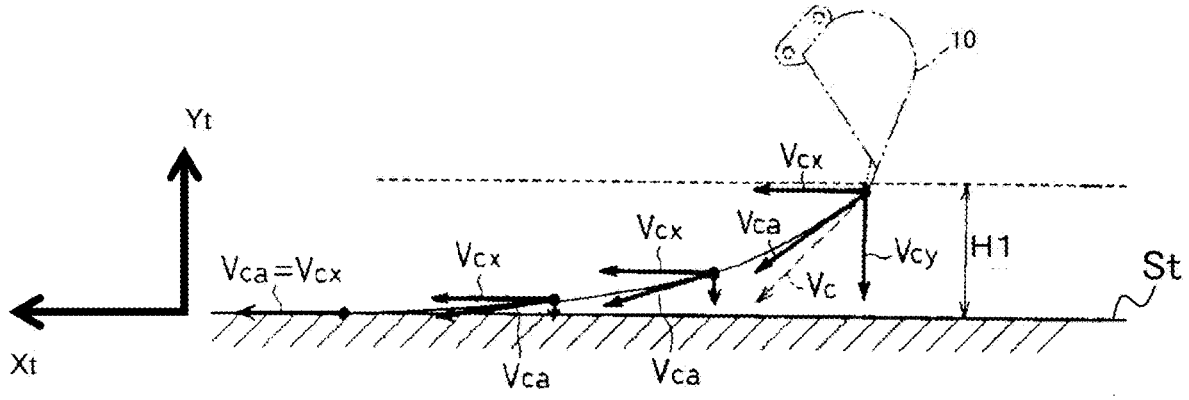

[FIG. 8]
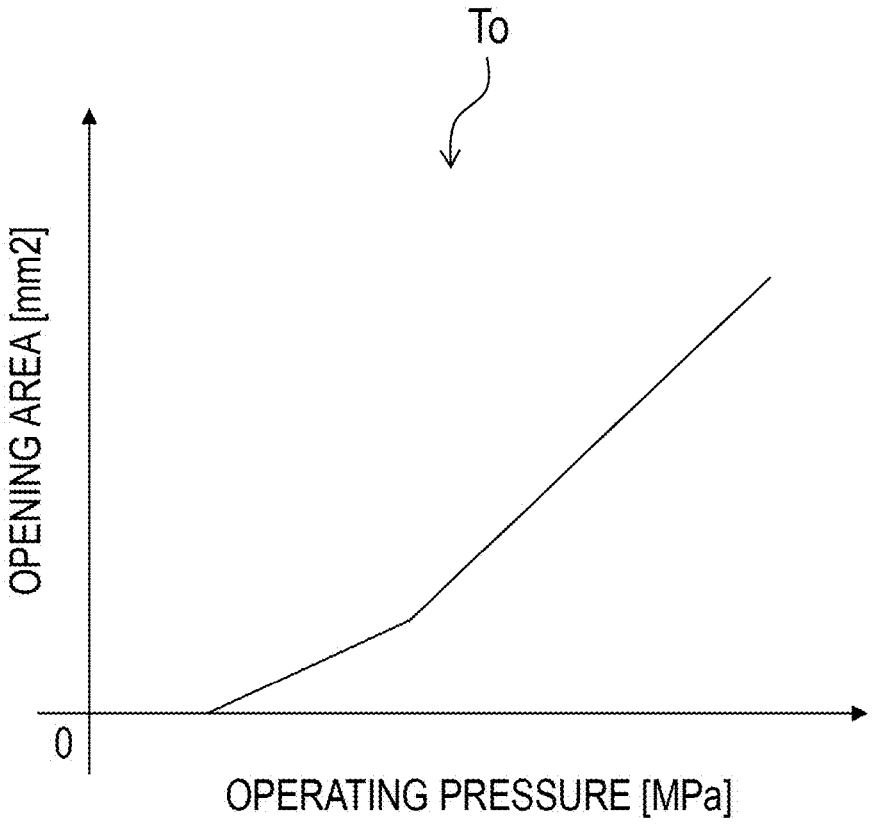

[FIG. 9]
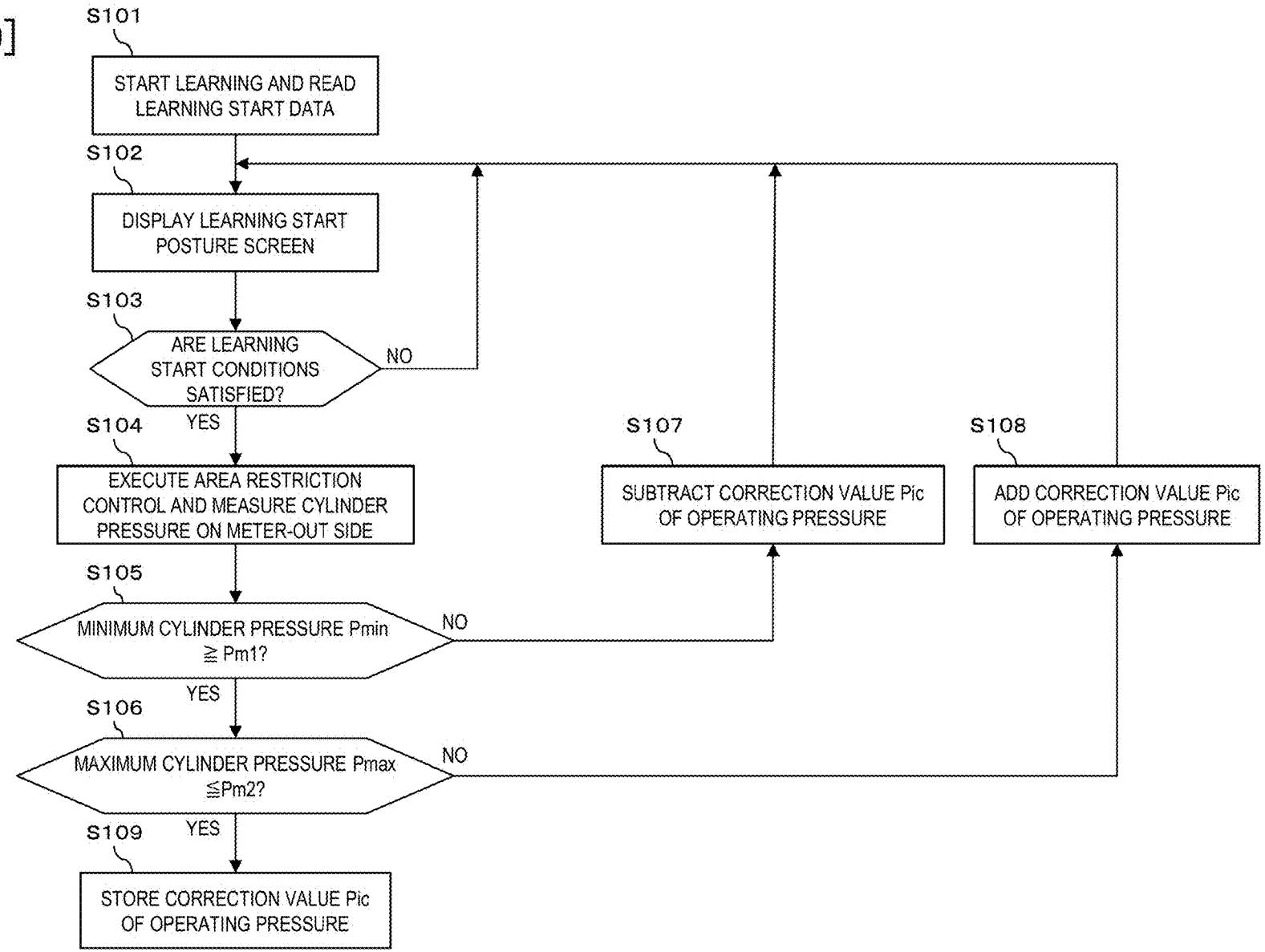

[FIG. 10]
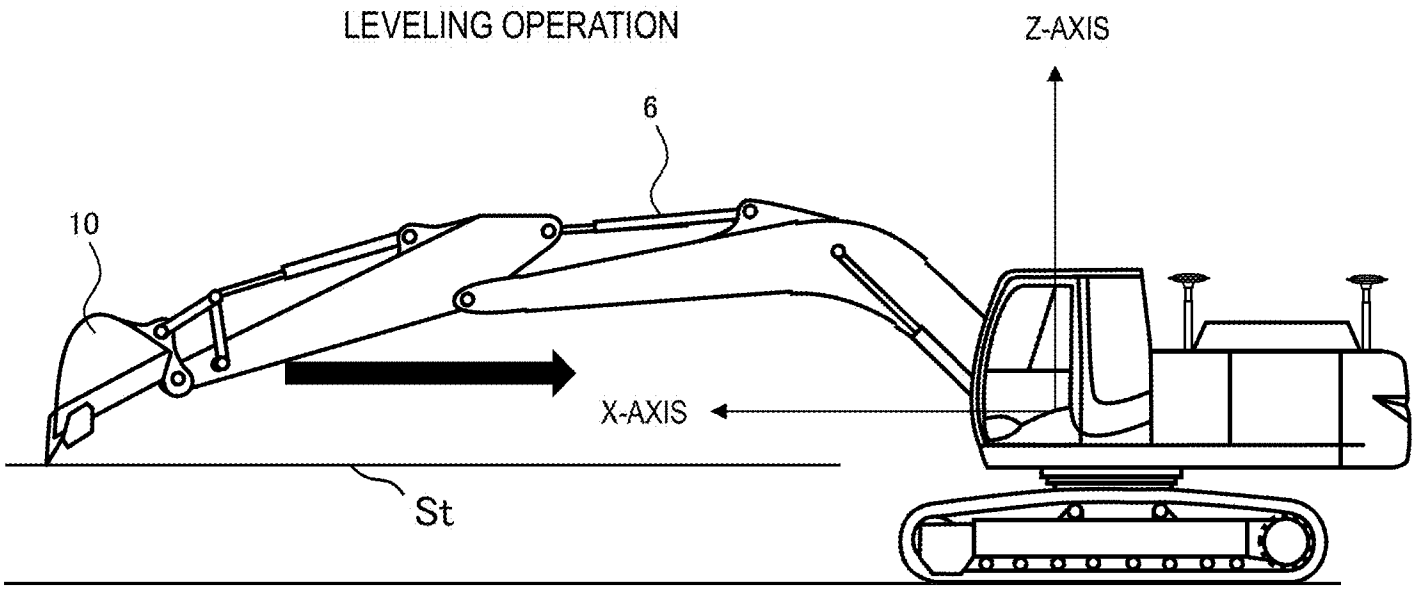

[FIG. 11]
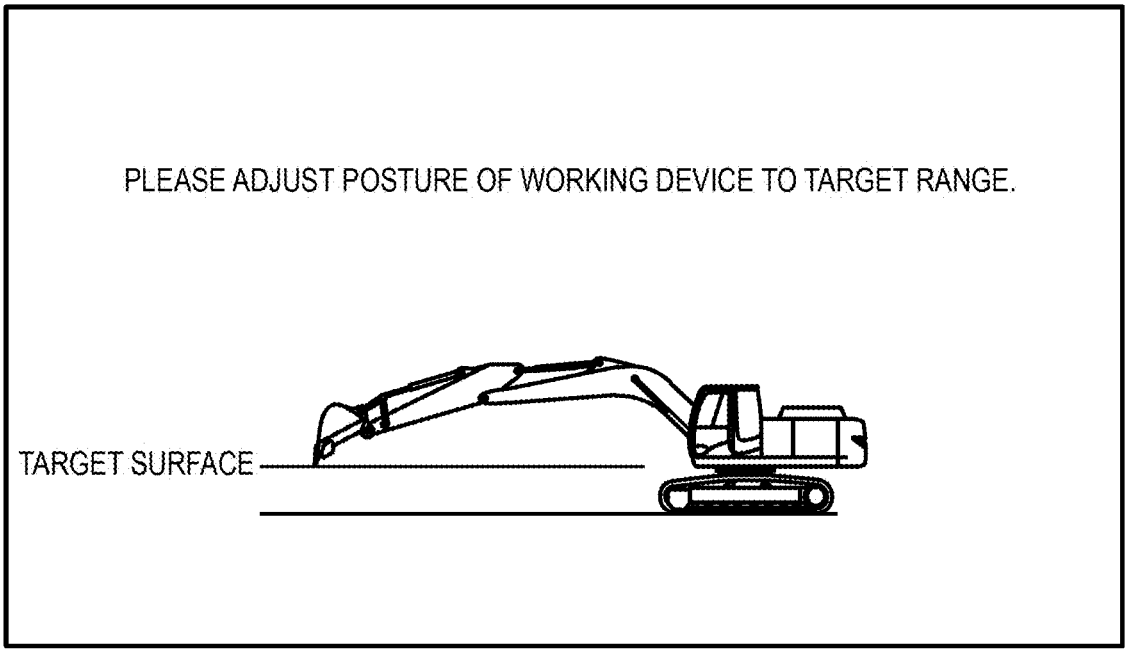

[FIG. 12]
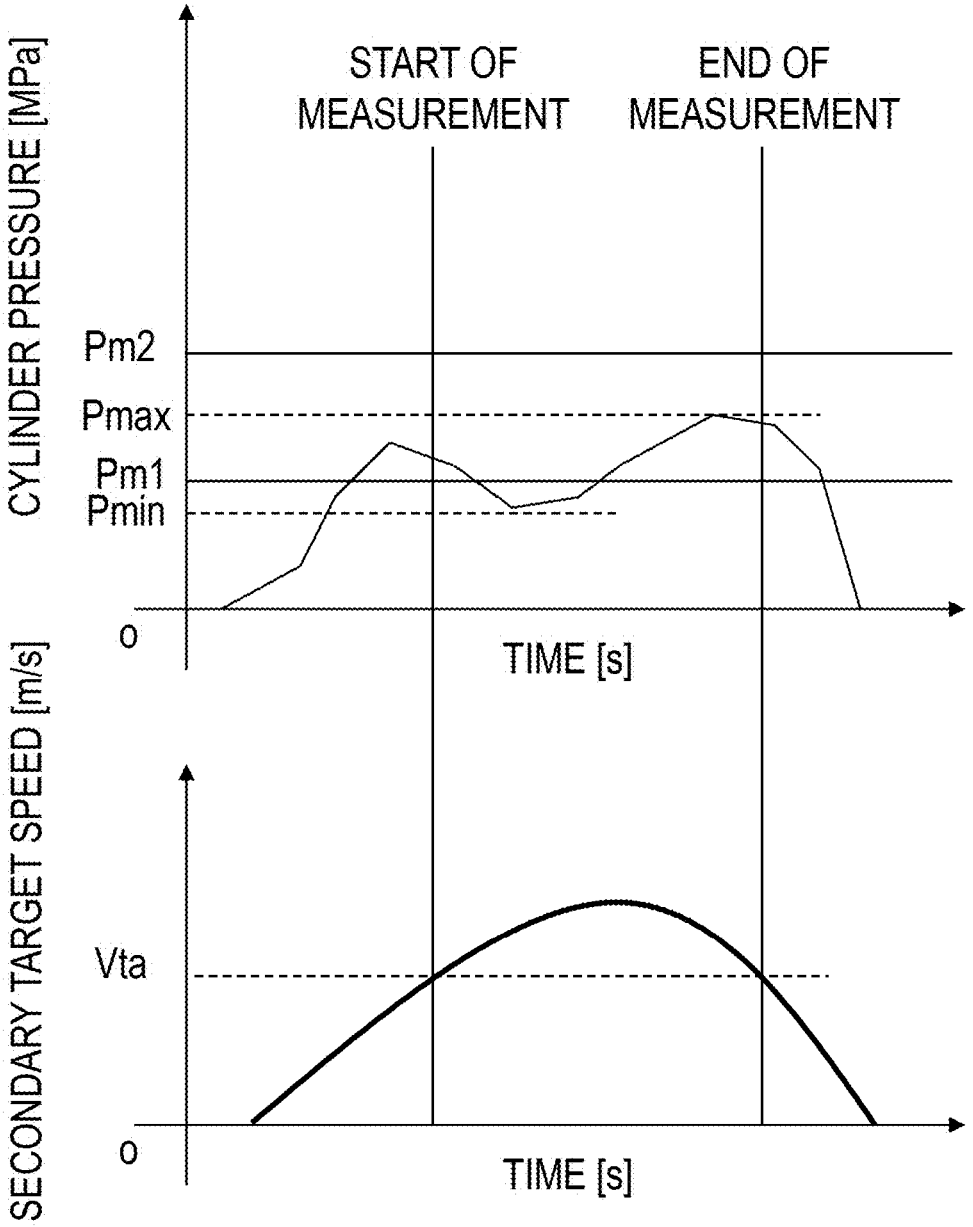

[FIG. 13]
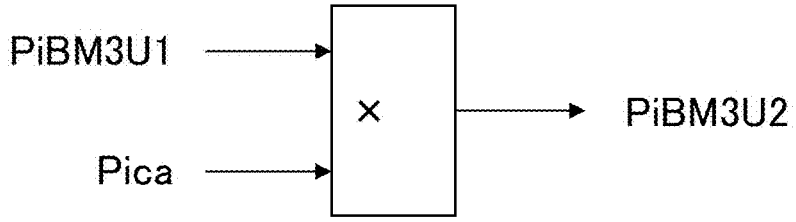

[FIG. 14]
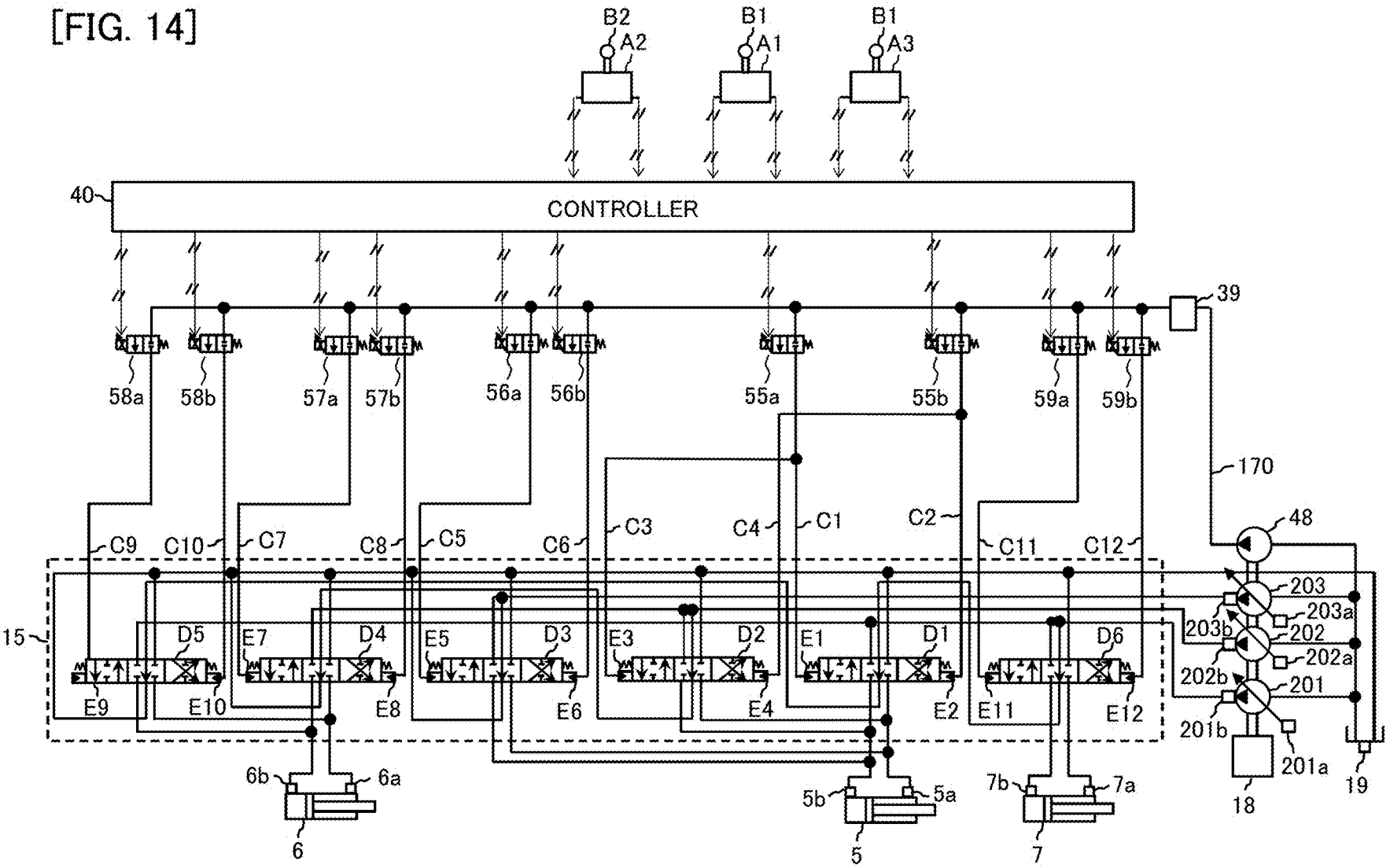

[FIG. 15]
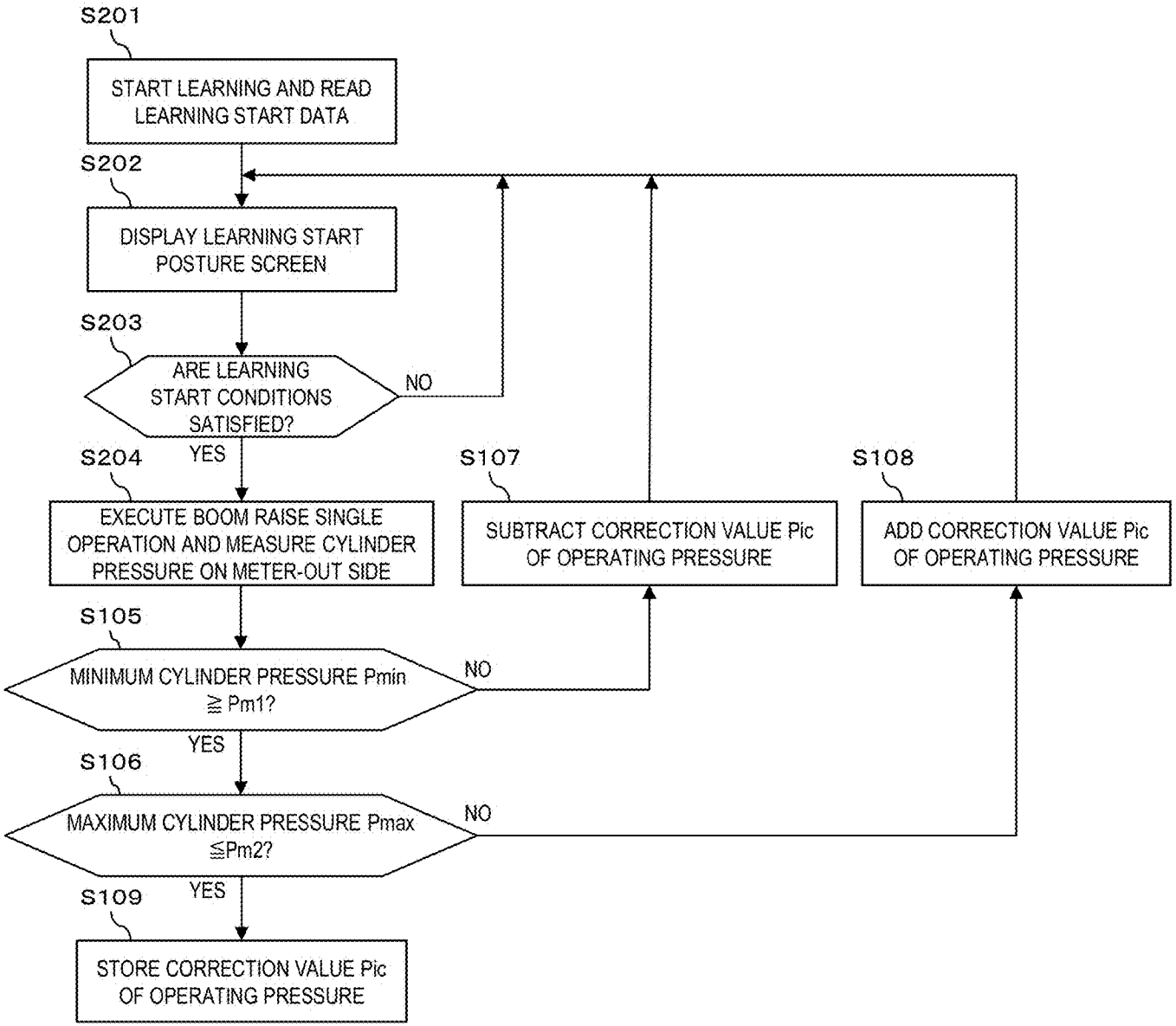

[FIG. 16]
BOOM RAISE SINGLE OPERATION
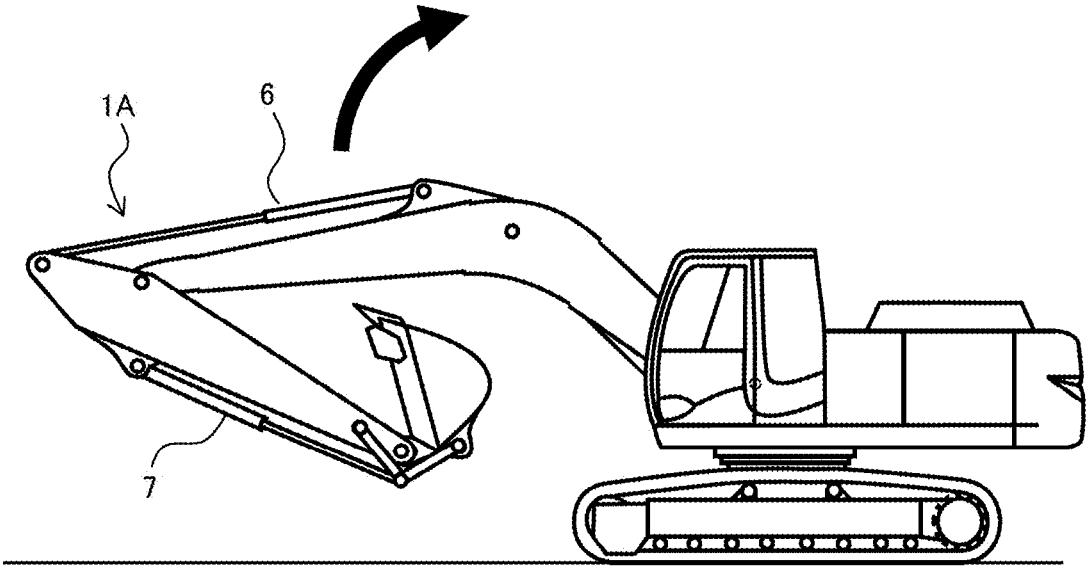

[FIG. 17]
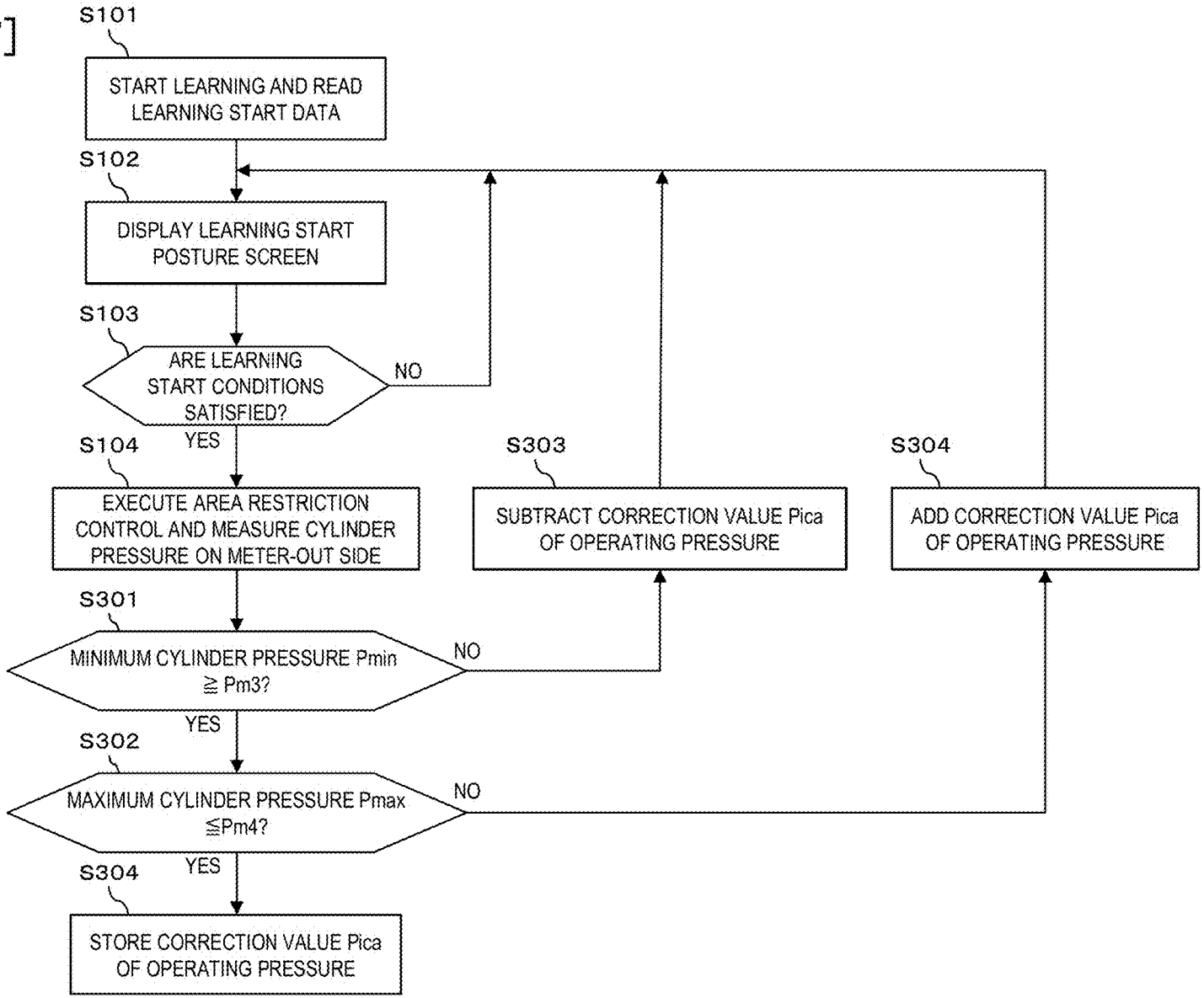

[FIG. 18]
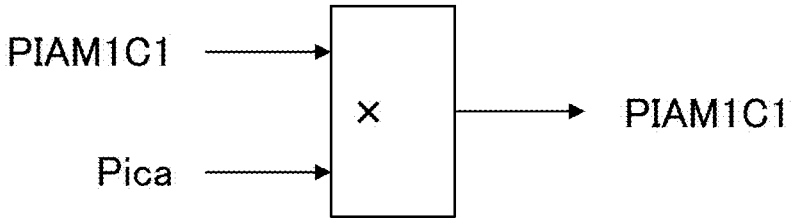

[FIG. 19]
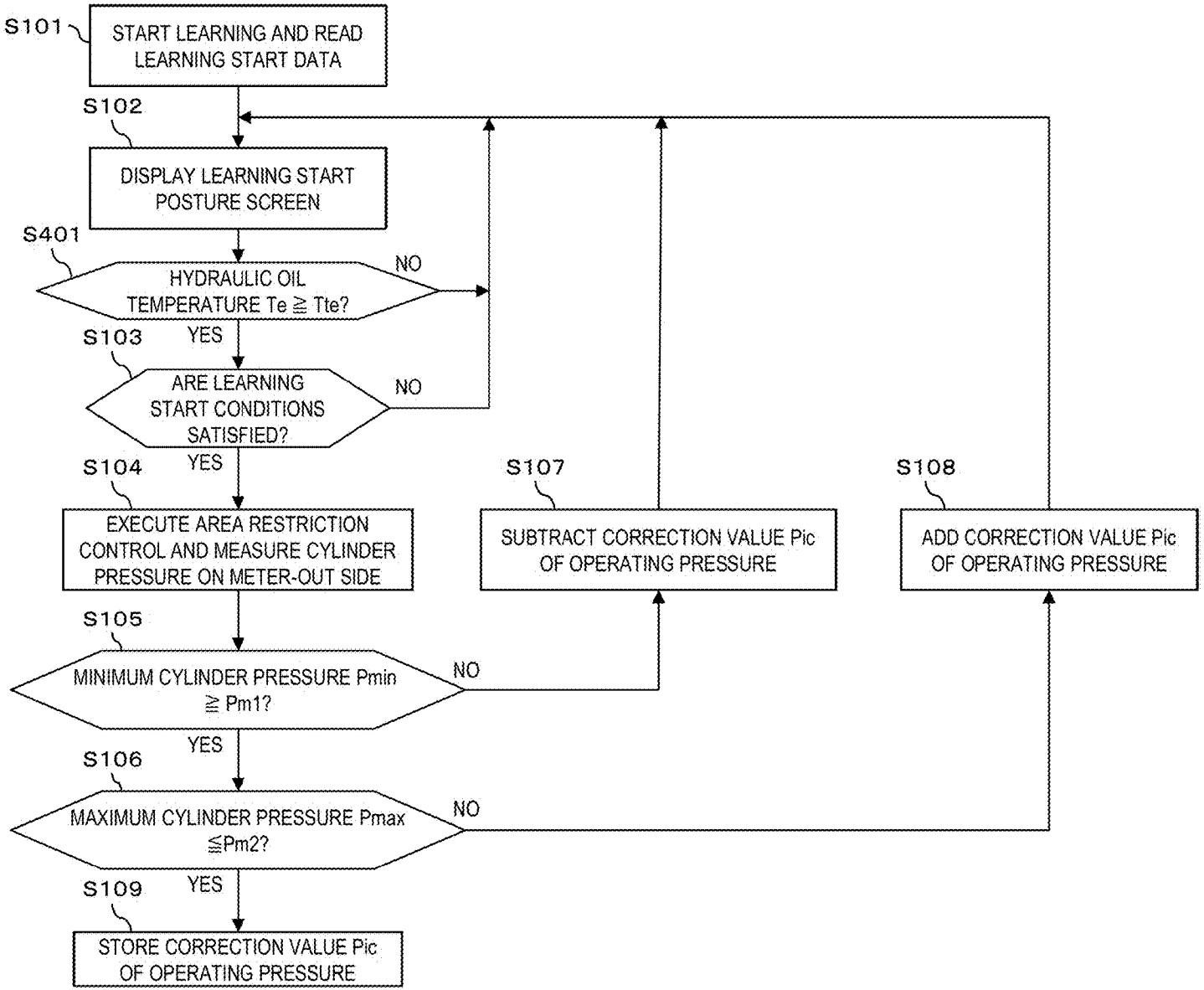

[FIG. 20]
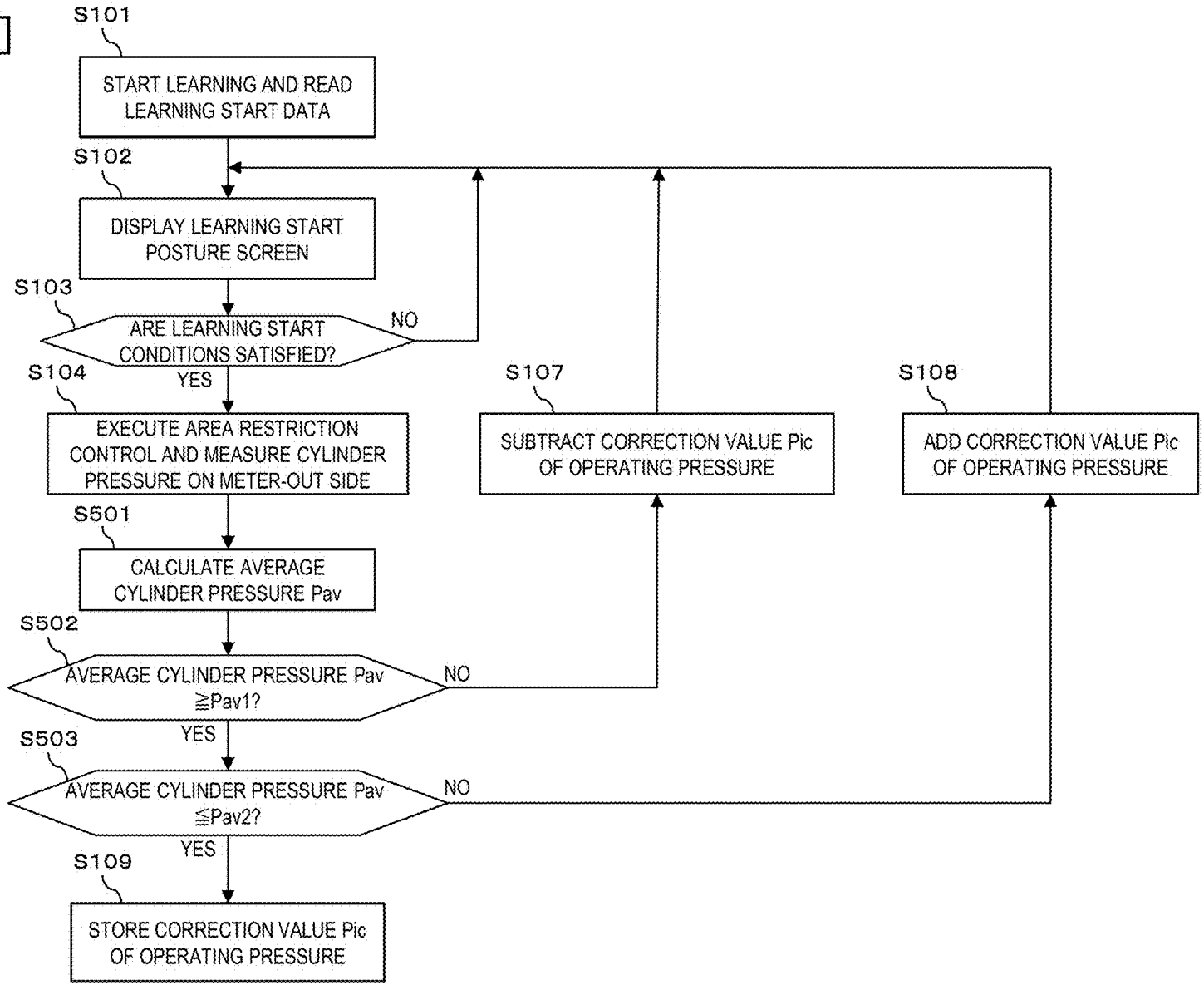

[FIG. 21]
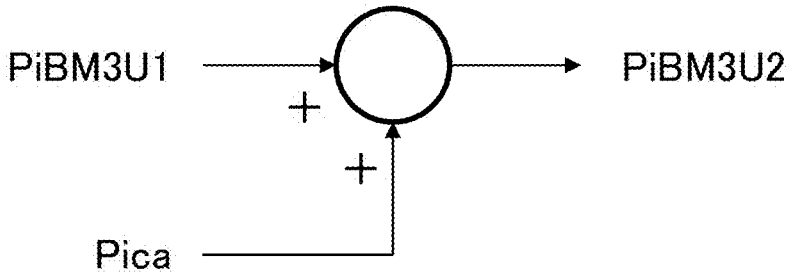

WORK MACHINE

TECHNICAL FIELD

The present invention relates to a work machine in which machine control is feasible.

BACKGROUND ART

In recent years, there has been an increasing demand for semi-automatic operation, automatic operation, and remote control of work machines such as hydraulic excavators, and the electronic control of work machines is advancing. As a method of electronic control of work machines, there is a method of controlling hydraulic actuators using solenoid valves. For example, a method is known in which a control valve for controlling hydraulic actuators such as hydraulic cylinders and hydraulic motors is operated by a pilot pressure (operating pressure) generated by a solenoid valve.

In semi-automatic or automatic operation, area restriction control that operates the bucket tip along a predetermined target surface is important to accurately control each actuator at its target speed, regardless of the load conditions or speed of a plurality of hydraulic actuators. Here, regarding the electronic control of work machines, a technique is known for improving excavation accuracy by calibrating the data used for control, taking into account individual differences in work machines (see Patent Document 1).

Patent Document 1 discloses an invention aimed at improving excavation accuracy in semi-automatic operation. The work device described in Patent Document 1 includes a controller that stores data defining the relationship between operating pressure and the operating speed of the hydraulic cylinder. The controller gradually increases the current value of the current output to the solenoid valve (electromagnetic proportional control valve) that generates the operating pressure. The controller calibrates the relationship between the operating pressure and the operating speed of the hydraulic cylinder in the data based on the current value at which the hydraulic cylinder starts operating and the operating speed of the hydraulic cylinder when a predetermined current value is output to the solenoid valve. The operating speed of the hydraulic cylinder is a factor of the meter-in flow rate, which is the flow rate of hydraulic oil flowing to the inlet side of the hydraulic cylinder, and the meter-in opening, which is the opening of the control valve for controlling the meter-in flow rate.

PRIOR ART DOCUMENTS

Patent Documents

Patent Document 1: International Publication No. 2015/137525

SUMMARY OF THE INVENTION

Problems to be Solved by the Invention

However, the calibration of the data defining the relationship between the operating pressure and the operating speed of the hydraulic cylinder based on the meter-in opening and meter-in flow rate as factors in Patent Document 1 does not take into account the pressure loss (brake pressure) due to the restriction of the meter-out opening. Therefore, even when driving the hydraulic cylinder at the desired operating speed, variations in the meter-out opening may deteriorate excavation accuracy.

Specifically, if the pressure loss due to the aperture of the meter-out opening is too large, the hydraulic cylinder will be driven in a state where the brake is too effective, resulting in deteriorated fuel efficiency and speed responsiveness of the hydraulic cylinder. On the other hand, if the pressure loss due to the aperture of the meter-out opening is too small, the hydraulic cylinder will be driven in a state where the brake is ineffective, resulting in loss of operational stability of the hydraulic cylinder and causing surging or deviation.

The present invention has been made in view of the above problems, and its purpose is to provide a work machine capable of performing work with high accuracy by preventing deterioration in speed responsiveness of the hydraulic cylinder driving the work device, as well as surging or deviation of the hydraulic cylinder.

Means for Solving the Problems

To achieve the above object, the work machine of the present invention includes a vehicle body, a work device rotatably attached to the vehicle body, a hydraulic cylinder driving the work device, an operating device for operating the work device, a hydraulic pump, a flow control valve for controlling the flow rate of hydraulic oil supplied from the hydraulic pump to the hydraulic cylinder, and a solenoid valve for generating the operating pressure of the flow control valve. Further, the work machine includes a controller that calculates the target speed of the hydraulic cylinder based on the operating variable of the operating device so that the operating range of the working device is limited to the target surface and above, calculates the target operating pressure of the flow control valve based on the target speed, and controls the solenoid valve according to the target operating pressure. The work machine further includes a pressure sensor for measuring the meter-out pressure of the hydraulic cylinder. The controller calculates a correction value for the target operating pressure to keep the measured meter-out pressure within a range from a predetermined first lower limit to a predetermined first upper limit while driving the hydraulic cylinder to perform a predetermined operation on the work device, and corrects the target operating pressure according to the correction value.

According to the present invention configured as described above, the target operating pressure of the flow control valve is corrected so that the meter-out pressure of the hydraulic cylinder driving the work device falls within a predetermined range. As a result, deterioration in speed responsiveness of the hydraulic cylinder driving the work device, as well as surging or deviation of the hydraulic cylinder, can be prevented, enabling work to be performed with high accuracy.

Advantages of the Invention

According to the present invention, deterioration in speed responsiveness of the hydraulic cylinder driving the work device, as well as surging or deviation of the hydraulic cylinder, can be prevented, enabling work to be performed with high accuracy.

BRIEF DESCRIPTION OF THE DRAWINGS

FIG. 1 Configuration diagram of a hydraulic excavator according to the first embodiment of the present invention FIG. 2 Configuration diagram of a hydraulic system mounted on a hydraulic excavator according to the first embodiment of the present invention FIG. 3 Diagram showing the reference coordinate system of a hydraulic excavator according to the first embodiment of the present invention FIG. 4 Hardware configuration diagram of a control system mounted on a hydraulic excavator according to the first embodiment of the present invention FIG. 5 Diagram showing an example of a display screen of a display device according to the first embodiment of the present invention FIG. 6 Functional block diagram of a controller according to the first embodiment of the present invention FIG. 7 Diagram showing an example of the trajectory when the tip of the bucket is MC'd according to the corrected target speed vector FIG. 8 Opening diagram of the meter-out passage section of the flow control valve FIG. 9 Flowchart showing the learning process executed by the learning section according to the first embodiment of the present invention FIG. 10 Diagram showing the learning start posture and learning start target surface according to the first embodiment of the present invention FIG. 11 Diagram showing an example of a learning start posture screen according to the first embodiment of the present invention FIG. 12 Diagram showing the time-series change of the cylinder pressure stored in the learning process according to the first embodiment of the present invention FIG. 13 Diagram showing the correction process according to the first embodiment of the present invention FIG. 14 Configuration diagram of a hydraulic system when an open center system is adopted FIG. 15 Flowchart showing the learning process executed by the learning section according to the second embodiment of the present invention FIG. 16 Diagram showing the learning start posture according to the second embodiment of the present invention FIG. 17 Flowchart showing the learning process executed by the learning section according to the third embodiment of the present invention FIG. 18 Diagram showing the correction process according to the third embodiment of the present invention FIG. 19 Flowchart showing the learning process executed by the learning section according to the fourth embodiment of the present invention FIG. 20 Flowchart showing the learning process executed by the learning section according to the sixth embodiment of the present invention FIG. 21 Diagram showing the correction process according to the seventh embodiment of the present invention

MODES FOR CARRYING OUT THE INVENTION

Hereinafter, embodiments of the work machine according to the present invention will be described with reference to the drawings, taking a hydraulic excavator as an example. In the drawings, equivalent elements are denoted by the same reference numerals, and redundant descriptions are omitted as appropriate.

Embodiment

FIG. 1 is a side view of a hydraulic excavator according to the first embodiment of the present invention. In this embodiment, a hydraulic excavator equipped with a bucket as an attachment (work tool) at the tip of the work device is illustrated and described, but the present invention can also be applied to hydraulic excavators equipped with attachments other than buckets.

As shown in FIG. 1, the hydraulic excavator 1 is configured to include a vehicle body 1B and an articulated work device (front working machine) 1A attached to the vehicle body 1B. The vehicle body 1B includes a traveling body 11 that travels by left and right traveling motors (hydraulic motors) and a swing body 12 mounted on the traveling body 11. The swing body 12 swings relative to the traveling body 11 by a swing motor (hydraulic motor). The swing center axis of the swing body 12 is vertical when the hydraulic excavator 1 is parked on a level surface. The swing body 12 is provided with an operating room 16.

The work device 1A is configured with a plurality of drive target members (boom 8, arm 9, and bucket 10) that each rotate within a vertical plane. The base end of the boom 8 is rotatably connected to the front part of the swing body 12 via a boom pin 91. The tip of the boom 8 is rotatably connected to the arm 9 via an arm pin 92, and the tip of the arm 9 is rotatably connected to the bucket 10 via a bucket pin 93. The boom 8 is driven by a boom cylinder 5, the arm 9 is driven by an arm cylinder 6, and the bucket 10 is driven by a bucket cylinder 7, all of which are hydraulic cylinders. The hydraulic cylinders 5, 6, and 7 each include a bottomed cylindrical cylinder tube with one end closed, a head cover closing the opening at the other end of the cylinder tube, a cylinder rod passing through the head cover and inserted into the cylinder tube, and a piston provided at the tip of the cylinder rod, dividing the interior of the cylinder tube into a rod chamber and a bottom chamber.

A boom angle sensor 30 is attached to the boom pin 91, an arm angle sensor 31 to the arm pin 92, a bucket angle sensor 32 to the bucket link 13, and a vehicle body inclination angle sensor 33 to the swing body 12. The angle sensors 30, 31, and 32 detect the rotation angles $\alpha$, $\beta$, and $\gamma$ (FIG. 3) of the boom 8, arm 9, and bucket 10, respectively, and output signals representing the detection results to a controller 40 (described later). The vehicle body inclination angle sensor 33 detects the vehicle body inclination angle $\theta$ (FIG. 3) of the swing body 12 (vehicle body 1B) relative to a reference surface (e.g., a horizontal plane) and outputs a signal representing the detection result to the controller 40 (described later).

The swing body 12 is equipped with a pair of antennas for the GNSS (Global Navigation Satellite System), hereinafter referred to as GNSS antennas, 14*a* and 14*b*. The controller 40 calculates the position and direction of the swing body 12 in the global coordinate system based on the satellite signals (GNSS radio waves) received by the GNSS antennas 14*a* and 14*b* from a plurality of positioning satellites.

FIG. 2 is a configuration diagram of the hydraulic system mounted on the hydraulic excavator 1. In FIG. 2, the hydraulic circuits related to the boom cylinder 5, arm cylinder 6, and bucket cylinder 7 are shown, while the hydraulic circuits related to the travel motor and swing motor are omitted.

Electric operation lever devices A1 to A3 are installed in the operating room 16. The electric operation lever devices A1 and A3 share the control lever B1, which is positioned on one side of the driver's seat (not shown). When the electric operation lever device A1 is operated by the control lever B1, the controller 40 actuates the solenoid valves 55*a*, 55*b*, 56*a*, and 56*b*. As a result, the boom cylinder 5 (boom 8) is driven. When the electric operation lever device A3 is operated by the control lever B1, the controller 40 actuates the solenoid valves 59*a* and 59*b*. As a result, the bucket cylinder 7 (bucket 10) is driven. The electric operation lever device A2 has a control lever B2, which is positioned on the other side of the driver's seat. When the electric operation lever device A2 is operated by the control lever B2, the controller 40 actuates the solenoid valves 57*a*, 57*b*, 58*a*, and 58*b*. As a result, the arm cylinder 6 (arm 9) is driven.

A pressure sensor 5*a* is attached to the rod-side input/output port of the boom cylinder 5, and a pressure sensor 5*b* is attached to the bottom-side input/output port. A pressure sensor 6*a* is attached to the rod-side input/output port of the arm cylinder 6, and a pressure sensor 6*b* is attached to the bottom-side input/output port. A pressure sensor 7*a* is attached to the rod-side input/output port of the bucket cylinder 7, and a pressure sensor 7*b* is attached to the bottom-side input/output port.

The swing body 12 is equipped with an engine 18, which is the prime mover, the first main pump 201, the second main pump 202, the third main pump 203, and the pilot pump 48. The main pumps 201, 202, 203, and the pilot pump 48 are driven by the engine 18 and discharge hydraulic oil drawn from the tank. A pressure sensor 201*b* is attached to the discharge port of the first main pump 201, a pressure sensor 202*b* is attached to the discharge port of the second main pump 202, and a pressure sensor 203*b* is attached to the discharge port of the third main pump 203.

The first main pump 201 has a regulator 201*a*, the second main pump 202 has a regulator 202*a*, and the third main pump 203 has a regulator 201*a*. The main pumps 201, 202, 203 are variable displacement hydraulic pumps whose discharge capacity per rotation (displacement volume) is controlled by regulators 201*a*, 202*a*, and 203*a*. In this embodiment, the main pumps 201, 202, 203 are swash plate type hydraulic pumps whose discharge capacity is controlled by the tilt angle of the swash plate. The main pumps 201, 202, 203 discharge pressure oil to drive a plurality of hydraulic actuators (such as the boom cylinder 5, arm cylinder 6, and bucket cylinder 7). The pilot pump 48 is a fixed displacement hydraulic pump with a constant discharge capacity per rotation.

The regulators 201*a*, 202*a*, 203*a* are driven by hydraulic signals corresponding to the target values of the regulator pressure (hereinafter also referred to as target regulator pressure) PPc201, PPc202, PPc203, calculated by the controller 40 based on the operation amount of the electric operation lever devices A1 to A3, to control the discharge capacity of the main pumps 201, 202, 203.

Specifically, the regulators 201*a*, 202*a*, 203*a* are each equipped with a regulator solenoid valve (not shown). The controller 40 outputs an electrical signal (excitation current) corresponding to the target regulator pressure to the regulator solenoid valve. As a result, the regulator solenoid valve is driven, and the regulator pressure for operating the swash plate is generated by the regulator solenoid valve. The regulator solenoid valve is an electromagnetic proportional reducing valve that generates a regulator pressure (pilot secondary pressure) corresponding to the command from the controller 40 by reducing the discharge pressure (pilot primary pressure) of the pilot pump 48.

The discharge flow rate of the main pumps 201, 202, 203 changes as the tilt angle of the swash plate (i.e., discharge capacity) changes due to the regulator pressure generated by the regulator solenoid valve. Therefore, the discharge flow rate of the main pumps 201, 202, 203 varies according to the target regulator pressure calculated by the controller 40.

The hydraulic system includes the plurality of solenoid valves 55*a* to 59*b*. The plurality of solenoid valves 55*a* to 59*b* generate operating pressure to operate the flow control valves D1 to D6, which will be described later, in response to commands (electrical signals) from the controller 40. The plurality of solenoid valves 55*a* to 59*b* are electromagnetic proportional reducing valves that generate operating pressure (pilot secondary pressure) corresponding to the operation direction and amount of the electric operation lever devices A1 to A3 by reducing the discharge pressure (pilot primary pressure) of the pilot pump 48.

A lock valve 39 is provided in the discharge line 170 of the pilot pump 48. The downstream side of the lock valve 39 in the discharge line 170 is branched into a plurality of paths and connected to solenoid valves 55*a* to 59*b*. In this embodiment, the lock valve 39 is an electromagnetic switching valve, and its solenoid is electrically connected to a position sensor of a gate lock lever (not shown) located in the operating room 16 of the swing body 12. The position of the gate lock lever is detected by the position sensor, and a signal corresponding to the position of the gate lock lever is input to the lock valve 39 from the position sensor. If the position of the gate lock lever is in the lock position, the lock valve 39 closes, blocking the discharge line 170, and the supply of pilot pressure from the pilot pump 48 to the solenoid valves 55*a* to 59*b* is interrupted. If the position of the gate lock lever is in the unlock position, the lock valve 39 opens, allowing the discharge line 170 to open, and the pilot pressure from the pilot pump 48 to the solenoid valves 55*a* to 59*b* is supplied. When the discharge line 170 is interrupted, the operation by the electric operation lever devices A1 to A3 is disabled, and operations such as excavation are prohibited.

The controller 40 generates electrical signals (excitation current) to drive the solenoid valves 55*a* to 59*b* according to the operation amount and direction of the control levers B1 to B2 of the electric operation lever devices A1 to A3, and outputs them to the solenoid valves 55*a* to 59*b* corresponding to the operation direction of the control levers B1, B2. The hydraulic system includes a control valve unit 15 that controls the flow of hydraulic oil discharged from the main pumps 201, 202, 203 and supplied to the hydraulic cylinders 5 to 7. The control valve unit 15 is configured to include the plurality of flow control valves D1 to D6.

The flow control valve D1 (first flow control valve) controls the flow of hydraulic oil supplied from the first main pump 201 to the boom cylinder 5 in response to the operation of the electric operation lever device A1. The operating pressure generated by the solenoid valves 55*a*, 55*b* driven by the command of the controller 40 is input to the pressure receiving chambers E1, E2 of the flow control valve D1 via pilot lines C1, C2. The spool of the flow control valve D1 is driven according to the operating pressure input to the pressure receiving chambers E1, E2. By driving the spool of the flow control valve D1, the supply direction and flow rate of pressure oil from the first main pump 201 to the boom cylinder 5 are controlled, and the boom cylinder 5 is driven.

The flow control valve D2 (second flow control valve) controls the flow of hydraulic oil supplied from the second main pump 202 to the boom cylinder 5 in response to the operation of the electric operation lever device A1. The operating pressure generated by the solenoid valves 55*a*, 55*b* driven by the command of the controller 40 is input to the pressure receiving chambers E3, E4 of the flow control valve D2 via pilot lines C3, C4. The spool of the flow control valve D2 is driven according to the operating pressure input to the pressure receiving chambers E3, E4. By driving the spool of the flow control valve D2, the supply direction and flow rate of pressure oil from the second main pump 202 to the boom cylinder 5 are controlled, and the boom cylinder 5 is driven.

The flow control valve D3 (third flow control valve) controls the flow of hydraulic oil supplied from the third main pump 203 to the boom cylinder 5 in response to the operation of the electric operation lever device A1. The operating pressure generated by the solenoid valves 56*a*, 56*b* driven by the command of the controller 40 is input to the pressure receiving chambers E5, E6 of the flow control valve D3 via pilot lines C5, C6. The spool of the flow control valve D3 is driven according to the operating pressure input to the pressure receiving chambers E5, E6. By driving the spool of the flow control valve D3, the supply direction and flow rate of pressure oil from the third main pump 203 to the boom cylinder 5 are controlled, and the boom cylinder 5 is driven.

Thus, the boom cylinder 5 is driven by controlling the flow of hydraulic oil discharged from the three main pumps 201, 202, 203 through the three flow control valves D1, D2, D3. If the controller 40 issues commands only to solenoid valves 56*a* and 56*b* among solenoid valves 55*a*, 55*b*, 56*a*, and 56*b*, the boom cylinder 5 is driven solely by the hydraulic oil discharged from the third main pump 203.

The flow control valve D4 (fourth flow control valve) controls the flow rate of hydraulic oil supplied from the second main pump 202 to the arm cylinder 6 in response to the operation of the electric operation lever device A2. The operating pressure generated by solenoid valves 57*a* and 57*b*, driven by the controller 40, is input into the pressure chambers E7 and E8 of the flow control valve D4 via pilot lines C7 and C8. The spool of the flow control valve D4 is driven according to the operating pressure input into the pressure chambers E7 and E8. By driving the spool of the flow control valve D4, the supply direction and flow rate of pressure oil from the second main pump 202 to the arm cylinder 6 are controlled, and the arm cylinder 6 is driven.

The flow control valve D5 (fifth flow control valve) controls the flow rate of hydraulic oil supplied from the first main pump 201 to the arm cylinder 6 in response to the operation of the electric operation lever device A2. The operating pressure generated by solenoid valves 58*a* and 58*b*, driven by the controller 40, is input into the pressure chambers E9 and E10 of the flow control valve D5 via pilot lines C9 and C10. The spool of the flow control valve D5 is driven according to the operating pressure input into the pressure chambers E9 and E10. By driving the spool of the flow control valve D5, the supply direction and flow rate of pressure oil from the first main pump 201 to the arm cylinder 6 are controlled, and the arm cylinder 6 is driven.

In this way, the arm cylinder 6 is driven by controlling the flow rate of hydraulic oil supplied from the two main pumps 201 and 202 through the two flow control valves D4 and D5. If the controller 40 issues commands only to solenoid valves 57*a* and 57*b* among solenoid valves 57*a*, 57*b*, 58*a*, and 58*b*, the arm cylinder 6 is driven solely by the hydraulic oil discharged from the second main pump 202.

The flow control valve D6 (sixth flow control valve) controls the flow rate of hydraulic oil supplied from the first main pump 201 to the bucket cylinder 7 in response to the operation of the electric operation lever device A3. The operating pressure generated by solenoid valves 59*a* and 59*b*, driven by the controller 40, is input into the pressure chambers E11 and E12 of the flow control valve D6 via pilot lines C11 and C12. The spool of the flow control valve D6 is driven according to the operating pressure input into the pressure chambers E11 and E12. By driving the spool of the flow control valve D6, the supply direction and flow rate of pressure oil from the first main pump 201 to the bucket cylinder 7 are controlled, and the bucket cylinder 7 is driven. In this way, the bucket cylinder 7 is driven by controlling the flow rate of hydraulic oil discharged from the first main pump 201 through the flow control valve D6.

FIG. 3 is an explanatory diagram of the method for calculating the bucket tip position. The posture of the working device 1A can be defined based on the shovel reference coordinate system shown in FIG. 3. The excavator reference coordinate system in FIG. 3 is a coordinate system set based on the swing body 12. In the excavator reference coordinate system, the origin is set at the central axis of the boom pin 91, the Z-axis is set parallel to the central axis of rotation of the swing body 12 (directly above the swing body 12), and the X-axis is set in a direction orthogonal to the Z-axis (forward of the swing body 12). Hereinafter, the inclination angle of the boom 8 with respect to the X-axis is referred to as the boom angle α, the inclination angle of the arm 9 with respect to the boom 8 is referred to as the arm angle β, and the inclination angle of the bucket 10 with respect to the arm 9 is referred to as the bucket angle γ. Additionally, the inclination angle of the vehicle body 1B (swing body 12) with respect to the horizontal plane (reference plane), i.e., the angle formed between the horizontal plane (reference plane) and the X-axis, is referred to as the vehicle body inclination angle θ.

The boom angle α is detected by the boom angle sensor 30, the arm angle β is detected by the arm angle sensor 31, the bucket angle γ is detected by the bucket angle sensor 32, and the vehicle body inclination angle θ is detected by the vehicle body inclination angle sensor 33. The boom angle α is minimized when the boom 8 is raised to its upper limit (boom cylinder 5 is in the fully extended state) and maximized when the boom 8 is lowered to its lower limit (boom cylinder 5 is in the fully shrank state). The arm angle β is minimized when the arm cylinder 6 is in the fully shrank state and maximized when the arm cylinder 6 is in the fully extended state. The bucket angle γ is minimized when the bucket cylinder 7 is in the fully shrank state (the state shown in FIG. 3) and maximized when the bucket cylinder 7 is in the fully extended state.

The position of the tip of the bucket 10 in the excavator reference coordinate system (hereinafter referred to as the tip position Pb) is expressed by the following equations (Equation 1 and Equation 2), with Xbk as the X-direction position and Zbk as the Z-direction position.

$$Xbk = L1\cos(\alpha) + L2\cos(\alpha+\beta) + L3\cos(\alpha+\beta+\gamma) \quad \text{(Equation 1)}$$

$$Zbk = L1\sin(\alpha) + L2\sin(\alpha+\beta) + L3\sin(\alpha+\beta+\gamma) \quad \text{(Equation 2)}$$

Here, L1 is the length from the central axis of the boom pin 91, which connects the swing body 12 and the boom 8, to the central axis of the arm pin 92, which connects the boom 8 and the arm 9. L2 is the length from the central axis of the arm pin 92 to the central axis of the bucket pin 93, which connects the arm 9 and the bucket 10. L3 is the length from the central axis of the bucket pin 93 to the tip position of the bucket 10 (e.g., the tip of the bucket 10) Pb.

Referring to FIG. 4, the control system 21 for performing Machine Control (MC) and Machine Guidance (MG) will be described. FIG. 4 is a hardware configuration diagram of the control system 21 mounted on the hydraulic excavator 1.

The controller 40 is equipped with an MC function that intervenes in the operator's operation under certain conditions to limit the operation of the working device 1A when at least one of the electric operation lever devices A1 to A3 is operated. MC includes "area restriction control" executed during arm operation by the electric operation lever device A2 or boom operation by the electric operation lever device A1, and "stop control" executed during boom lowering operation by the electric operation lever device A1 or bucket operation by the electric operation lever device A3.

Area restriction control is also called "grading control." While area restriction control is being executed, at least one of the boom cylinder 5, arm cylinder 6, and bucket cylinder 7 is controlled to prevent the working device 1A from excavating the area below the excavation target surface St (see FIG. 3). In area restriction control, the operation of the working device 1A is controlled so that the tip of the bucket 10 moves along the excavation target surface St through arm operation or boom operation. For example, the controller 40 issues a command to raise or lower the boom so that the velocity vector of the tip of the bucket 10 in the direction perpendicular to the excavation target surface St becomes zero when an arm operation is performed. Additionally, the controller 40 issues a command to roll-in or extend the arm so that the velocity vector of the tip of the bucket 10 in the direction perpendicular to the excavation target surface St becomes zero when a boom operation is performed. As a result, the trajectory of the tip of the bucket 10 due to the rotational motion of the arm operation or boom operation is corrected to a linear path along the excavation target surface St.

Stop control is a control that stops the boom lowering operation or bucket operation to prevent the tip of the bucket 10 from entering the area below the excavation target surface St. In stop control, the controller 40 decelerates the boom lowering operation or bucket operation as the tip of the bucket 10 approaches the excavation target surface St.

In this embodiment, the control point of the working device 1A during MC is set at the tip of the bucket 10 of the hydraulic excavator 1, but the control point can be changed to any point at the tip portion of the working device 1A other than the tip of the bucket 10. For example, the control point may be set at the bottom surface of the bucket 10 or the outermost part of the bucket link 13. Additionally, the point on the bucket 10 closest to the excavation target surface St may be set as the control point. In other words, the control point may change depending on the situation.

In MC, there is "automatic control," where the operation of the working device 1A is controlled by the controller 40 when the electric operation lever devices A1 to A3 are not operated, and "semi-automatic control," where the operation of the working device 1A is controlled by the controller 40 only when the electric operation lever devices A1 to A3 are operated. MC is also called "intervention control" because the control by the controller 40 intervenes in the operator's operation.

Additionally, as MG, the control system 21 executes a process to display the positional relationship between the excavation target surface St and the working device 1A (e.g., the bucket 10) on the display device 53, as shown in FIG. 5.

As shown in FIG. 4, the control system 21 includes the controller 40, a posture detection device 50 connected to the controller 40 and outputting signals to the controller 40, a target surface setting device 51, a vehicle body position detection device 14, electric operation lever devices A1 to A3, an external input device 96, pressure sensors 5*a* to 7*b*, and a temperature sensor 19. Additionally, the control system 21 includes a display device 53 connected to the controller 40 and controlled based on signals from the controller 40, regulators 201*a*, 202*a*, 203*a*, and solenoid valves 55*a* to 59*b*.

The posture detection device 50 includes a boom angle sensor 30, an arm angle sensor 31, a bucket angle sensor 32, and a vehicle body inclination angle sensor 33. These angle sensors 30, 31, 32, and 33 acquire information regarding the posture of the hydraulic excavator 1 and output signals corresponding to that information. Namely, the angle sensors 30, 31, 32, and 33 function as posture sensors that detect the posture of the working device 1A, specifically the posture of the plurality of drive target members (boom 8, arm 9, and bucket 10) that constitute the working device 1A. It should be noted that the angle sensors 30, 31, and 32 can adopt potentiometers that acquire the boom angle $\alpha$, arm angle $\beta$, and bucket angle $\gamma$ as posture-related information and output signals (voltage) corresponding to the acquired angles. Additionally, the vehicle body inclination angle sensor 33 can adopt an IMU (Inertial Measurement Unit) that acquires orthogonal three-axis angular velocity and acceleration as information related to the posture of the swing body 12, calculates the vehicle body inclination angle $\theta$ based on this information, and outputs a signal representing the vehicle body inclination angle $\theta$ to the controller 40.

It should be noted that the calculation of the vehicle body inclination angle $\theta$ may be performed by the controller 40 based on the output signal of the IMU. Furthermore, the angle sensors 30 to 32 can each be replaced with sensors (such as IMUs) that measure the inclination angle relative to a reference plane or sensors that detect the stroke of hydraulic cylinders 5 to 7.

The target surface setting device 51 is an input device that includes a controller for MC, capable of outputting information related to the excavation target surface, such as position information of the excavation target surface and inclination angle information relative to the reference plane (horizontal plane), as command signals to the controller 40. For example, the target surface setting device 51 is connected to an external terminal (not shown) that stores three-dimensional data of the excavation target surface defined in a global coordinate system (absolute coordinate system), and the three-dimensional data of the excavation target surface is input via a touch panel, which is an input device including a controller for MC, from the external terminal. It should be noted that the input of the excavation target surface to the controller 40 via the target surface setting device 51 may be performed manually by the operator.

The vehicle body position detection device 14 includes a pair of GNSS antennas 14*a* and 14*b*, calculates the position and direction of the vehicle body 1B (swing body 12), and outputs the calculation results to the controller 40.

The external input device 96 is an input device operated by the operator, which outputs input signals corresponding to the operation to the controller 40. The external input device 96 is, for example, a capacitive touch sensor provided on the display screen of the display device 53. Additionally, the external input device 96 may be equipped with a plurality of switches and levers.

FIG. 5 is a diagram showing an example of the display screen of the display device 53. As shown in FIG. 5, the display device 53 displays various display images on the display screen based on display control signals from the controller 40. The display device 53 is, for example, a touch panel type liquid crystal monitor installed in the operating room 16. The controller 40, as an MG function, displays an image representing the positional relationship between the excavation target surface St and the working device 1A (e.g., bucket 10) on the display screen of the display device 53. In the example shown in the figure, an image representing the excavation target surface St and bucket 10, and the distance from the excavation target surface St to the tip of bucket 10 are displayed as the target surface distance H1. The target surface distance H1 takes a positive value in the upward direction and a negative value in the downward direction relative to the excavation target surface St. It should be noted that the display image shown in FIG. 5 can be displayed on the display device 53 regardless of whether the mode for executing MC is set by a mode switch (not shown) operated by the operator. The operator can operate the working device 1A with reference to this display image.

The controller 40 is composed of a computer equipped with processing devices 41 such as a CPU (Central Processing Unit), MPU (Micro Processing Unit), DSP (Digital Signal Processor), non-volatile memory 42 such as ROM (Read Only Memory), flash memory, hard disk drive, volatile memory 43 called RAM (Random Access Memory), input interface 44, output interface 45, and other peripheral circuits. These hardware components work together to operate software and realize a plurality of functions. It should be noted that the controller 40 may be composed of a single computer or a plurality of computers. Additionally, the processing device 41 may use an ASIC (Application Specific Integrated Circuit), FPGA (Field Programmable Gate Array), or similar.

The non-volatile memory 42 stores various data such as programs executable for various calculations and thresholds. In other words, the non-volatile memory 42 is a storage medium (storage device) readable for programs that realize the functions of this embodiment. The volatile memory 43 is a storage medium (storage device) that temporarily stores calculation results by the processing device 41 and signals input from the input interface 44. The processing device 41 is a device that expands the program stored in the non-volatile memory 42 into the volatile memory 43 and executes calculations, performing predetermined processing on data acquired from the input interface 44, non-volatile memory 42, and volatile memory 43 according to the program.

The input interface 44 converts signals input from various devices (posture detection device 50, target surface setting device 51, vehicle body position detection device 14, electric operation lever devices A1 to A3, external input device 96, pressure sensors 5*a* to 7*b*, 201*b*, 202*b*, 203*b*, and temperature sensor 19) into data that can be calculated by the processing device 41. Additionally, the output interface 45 generates output signals corresponding to the calculation results of the processing device 41 and outputs these signals to various devices (regulators 201*a*, 202*a*, 203*a*, solenoid valves 55*a* to 59*b*, and display device 53).

By controlling the regulators 201*a* to 203*a*, the controller 40 changes the discharge capacity of the main pumps 201 to 203. By controlling the solenoid valves 55*a* to 59*b*, the controller 40 actuates the spools of the flow control valves D1 to D6, thereby operating the hydraulic cylinders 5 to 7. By controlling the display device 53, the controller 40 displays a predetermined image on the display screen of the display device 53.

—Functions of the Controller—

Referring to FIG. 6, the details of the functions of the controller 40 will be described. FIG. 6 is a functional block diagram of the controller 40. The controller 40 functions as an operation amount calculation section 141, posture calculation section 142, target surface calculation section 143, target speed calculation section 144, target pressure calculation section 145, correction target pressure calculation section 146, valve command calculation section 147, learning section 149, and display control section 150 by executing the program stored in the non-volatile memory 42. The target pressure calculation section 145, correction target pressure calculation section 146, and valve command calculation section 147 function as a solenoid valve control section 148 that controls the hydraulic actuators, which are the hydraulic cylinders 5, 6, and 7, by controlling the solenoid valves 55*a* to 59*b*.

The operation amount calculation section 141 calculates the target values of the operating pressure (hereinafter also referred to as operation amount operating pressure) Pi0 (PiBM12U0, PiBM3U0, PiBM12D0, PiBM3D0, PiAM1C0, PiAM2C0, PiAM1D0, PiAM2D0, PiBKC0, PiBKD0) generated by the solenoid valves 55*a* to 59*b* based on the operation signals (operation amount and operation direction) of the electric operation lever devices A1, A2, and A3. The operation amount calculation section 141 calculates the target value of the operating pressure PiBM12U0 generated by the solenoid valve 55*a* and the target value of the operating pressure PiBM3U0 generated by the solenoid valve 56*a* when the boom raise operation is performed by the electric operation lever device A1. The operation amount calculation section 141 calculates the target value of the operating pressure PiBM12D0 generated by the solenoid valve 55*b* and the target value of the operating pressure PiBM3D0 generated by the solenoid valve 56*b* when the boom lower operation is performed by the electric operation lever device A1.

The operation amount calculation section 141 calculates the target value of the operating pressure PiAM1C0 generated by the solenoid valve 57*a* and the target value of the operating pressure PiAM2C0 generated by the solenoid valve 58*a* when the arm roll-in (arm crowd) operation is performed by the electric operation lever device A2. The operation amount calculation section 141 calculates the target value of the operating pressure PiAM1D0 generated by the solenoid valve 57*b* and the target value of the operating pressure PiAM2D0 generated by the solenoid valve 58*b* when the arm extend (arm dump) operation is performed by the electric operation lever device A2.

The operation amount calculation section 141 calculates the target value of the operating pressure PiBKC0 generated by the solenoid valve 59*a* when the bucket roll-in (bucket crowd) operation is performed by the electric operation lever device A3. The operation amount calculation section 141 calculates the target value of the operating pressure PiBKD0 generated by the solenoid valve 59*b* when the bucket roll-out (bucket dump) operation is performed by the electric operation lever device A3.

The posture calculation section 142 calculates the posture of the working device 1A in the excavator reference coordinate system (local coordinate system) and the tip position Pb of the bucket 10 based on the posture information (angle information) detected by the posture detection device 50 and the dimension information (L1, L2, L3) of the working device 1A stored in the non-volatile memory 42. The tip position Pb (Xbk, Zbk) of the bucket 10 can be calculated by equations (1) and (2) as previously described. If the posture of the working device 1A in the global coordinate system and the tip position of the bucket 10 are required, the posture calculation section 142 converts the coordinates of the excavator reference coordinate system into the coordinates of the global coordinate system based on the position and direction of the swing body 12 detected by the vehicle body position detection device 14 in the global coordinate system.

The target surface calculation section 143 sets the excavation target surface St based on information from the target surface setting device 51. Specifically, the target surface calculation section 143 calculates the position information of the excavation target surface St based on information from the target surface setting device 51 and stores the calculation result in volatile memory 43. The target surface calculation section 143 calculates the excavation target surface, provided in three-dimensional data via the target surface setting device 51, as a two-dimensional excavation target surface St. This is done by cutting the excavation target surface with the plane on which the working device 1A moves (the operating plane of the working device), resulting in a cross-sectional shape (see FIG. 3).

Note that in FIG. 3, there is one excavation target surface St, but there may be a plurality of excavation target surfaces St. When the plurality of excavation target surfaces St exist, the target surface calculation section 143 sets the one closest to the tip of the bucket 10, the one located vertically below the tip of the bucket 10, or an arbitrarily selected one as the excavation target surface St to be calculated.

The target speed calculation section 144 calculates the target speed of each hydraulic cylinder 5, 6, 7 in the area restriction control (grading control) to prevent the working device 1A from excavating below the excavation target surface St beyond the excavation target surface St. The target speed calculation section 144 calculates the target speed of each hydraulic cylinder 5, 6, 7 based on the calculation results of the posture calculation section 142 and the operation amount calculation section 141.

Referring to FIG. 7, the method of calculating the target speed during area restriction control is explained in detail. FIG. 7 is a diagram showing an example of the trajectory of the tip of the bucket 10 when it is controlled according to the corrected target speed vector Vca. In this explanation, as shown in FIG. 7, the Xt axis and Yt axis are set. The Xt axis is an axis parallel to the excavation target surface St, and the Yt axis is an axis perpendicular to the excavation target surface St.

The target speed calculation section 144 calculates the primary target speed of each hydraulic cylinder 5, 6, 7 based on the operation amount operating pressure Pi0 (PiBM12U0, PiBM3U0, PiBM12D0, PiBM3D0, PiAM1C0, PiAM2C0, PiAM1D0, PiAM2D0, PiBKC0, PiBKD0) of the solenoid valves 55*a* to 59*b* calculated by the operation amount calculation section 141.

The target speed calculation section 144 calculates the target speed vector Vc of the tip of the bucket 10 shown in FIG. 7 based on the primary target speed of each hydraulic cylinder 5, 6, 7, the tip position Pb of the bucket 10 calculated by the posture calculation section 142, and the dimension information (L1, L2, L3, etc.) of the working device 1A stored in non-volatile memory 42.

When the target surface distance H1, which is the distance between the tip of the bucket 10 and the excavation target surface St, approaches zero, the target speed calculation section 144 corrects the primary target speed of the necessary hydraulic cylinders among hydraulic cylinders 5, 6, and 7 so that the component Vcy (the speed component in the Yt axis direction) of the target speed vector Vc at the tip of the bucket 10, which is perpendicular to the excavation target surface St, approaches zero, and calculates the secondary target speed. As a result, the target speed vector Vc of the tip of the bucket 10 is converted into the corrected target speed vector Vca. When the target surface distance H1 is zero, the target velocity vector Vca consists only of the parallel component Vcx (velocity component in the Xt axis direction) relative to the excavation target surface St. Therefore, in the area restriction control, the tip of the bucket 10 is retained on or above the excavation target surface St to prevent it from penetrating into the area below the excavation target surface St. Hereinafter, the control that converts (corrects) the speed vector of the tip of the bucket 10 is also referred to as direction conversion control.

Direction conversion control can be executed in combination with boom raise or boom lower and arm roll-in, or in combination with boom raise or boom lower and arm dump. In either case, when the target speed vector Vc includes a downward component (Vcy<0) approaching the excavation target surface St, the target speed calculation section 144 calculates the target speed of the boom cylinder 5 in the boom raise direction to cancel out the downward component. Conversely, when the target speed vector Vc includes an upward component (Vcy>0) moving away from the excavation target surface St, the target speed calculation section 144 calculates the target speed of the boom cylinder 5 in the boom lower direction to cancel out the upward component.

If a mode is set where area restriction control (grading control) is not performed by a mode switch (not shown), the target speed calculation section 144 does not perform correction on the primary target speed of each hydraulic cylinder 5 to 7 according to the operation of the electric operation lever devices A1 to A3.

In this way, the target speed calculation section 144 calculates the target speed, which is the target value of the extend speed/shrink speed of the hydraulic cylinders 5, 6, 7, based on the calculation results of the operation amount calculation section 141 and the posture calculation section 142.

The target pressure calculation section 145 calculates the target spool opening of the flow control valves D1 to D6 based on the detection results of the pressure sensors 5*a* to 7*b*, 201*b* to 203*b*, and the target speed of each hydraulic cylinder 5, 6, 7 calculated by the target speed calculation section. Then, the target pressure calculation section 145 converts this target spool opening into the target operating pressure Pi1 (PiBM12U1, PiBM3U1, PiBM12D1, PiBM3D1, PiAM1C1, PiAM2C1, PiAM1D1, PiAM2D1, PiBKC1, PiBKD1) based on the spool opening table and outputs it.

In this embodiment, the target pressure calculation section 145 calculates the target spool opening on the meter-out side of the flow control valves D1 to D6 based on the detection results of the pressure sensors 5*a* to 7*b*, 201*b* to 203*b*, and the target speed of each hydraulic cylinder 5, 6, 7 calculated by the target speed calculation section. Then, the target pressure calculation section 145 converts this target spool opening on the meter-out side into the target operating pressure Pi1 (PiBM12U1, PiBM3U1, PiBM12D1, PiBM3D1, PiAM1C1, PiAM2C1, PiAM1D1, PiAM2D1, PiBKC1, PiBKD1) based on the target opening table on the meter-out side of the flow control valves D1 to D6 and outputs it.

Referring to FIG. 8, an example of the opening characteristics of the meter-out passage section of the flow control valves D1 to D6 is explained. FIG. 8 is an opening diagram of the meter-out passage section of the flow control valves D1 to D6, showing the relationship between the operating pressure input to the pressure receiving chambers E1, E3, E5, E7, E9, E11 of the flow control valves D1 to D6 and the opening area of the meter-out passage section of the flow control valves D1 to D6. As shown in FIG. 8, the opening area of the meter-out passage section of the flow control valves D1 to D6 increases as the operating pressure generated by the solenoid valves 55*a* to 59*a* increases. The non-volatile memory 42 of the controller 40 stores the opening characteristic table To that defines the relationship between the operating pressure and the opening area of the flow control valves D1 to D6.

The target pressure calculation section 145 refers to the opening characteristic table To and calculates the target operating pressure Pi1 (PiBM12U1, PiBM3U1, PiBM12D1, PiBM3D1, PiAM1C1, PiAM2C1, PiAM1D1, PiAM2D1, PiBKC1, PiBKD1), which is the target value of the operating pressure, based on the meter-out target opening area Aout (Aout_Bm1U, Aout_Bm3U, Aout_Bm1D, Aout_Bm3D, Aout_Am1C, Aout_Am2C, Aout_Am1D, Aout_Am2D, Aout_BkC, Aout_BkD).

The target pressure calculation section 145 calculates the target flow rates Q201, Q202, Q203 of each main pump 201, 202, 203 from the sum of the target flow rates on the meter-in side of each hydraulic cylinder 5 to 7 assigned to each main pump 201, 202, 203.

The non-volatile memory 42 stores in advance a regulator pressure table that defines the relationship between the target flow rates Q201, Q202, Q203 of the main pumps 201, 202, 203 and the target regulator pressures of the regulators 201*a*, 202*a*, 203*a*. The regulator pressure table is defined for each main pump 201, 202, 203.

The target pressure calculation section 145 refers to the regulator pressure table and calculates the target regulator pressures PPc201, PPc202, PPc203 based on the calculated target flow rates Q201, Q202, Q203 of the main pumps 201, 202, 203.

The correction target pressure calculation section 146 reads out the correction value obtained by the learning process of the learning section 149, which will be described later. Based on the read correction value and the target pressure calculated by the target pressure calculation section 145, the corrected target pressure Pi2 is calculated and output. Details of the correction processing in the correction target pressure calculation section 146 will be described later.

The relationship between the opening area of flow control valves D1 to D6 and the operating pressure generated by solenoid valves 55*a* to 59*b* results in variations in the opening characteristic table to due to manufacturing errors of the flow control valves D1 to D6. Manufacturing errors of the flow control valves D1 to D6 include machining errors of the spools of the flow control valves D1 to D6, variations in the spring constant of the spring (centering spring) for holding the spool in the neutral position, and machining errors of the valve casing that holds the spool slidably. In directional change control within area restriction control, it may be executed by a combination of boom raise or boom lower with arm roll-in, or by a combination of boom raise or boom lower with arm extend. Therefore, the precision of the area restriction control particularly deteriorates due to variations (individual differences) in the opening characteristic table To caused by manufacturing errors of the flow control valve corresponding to the boom or arm.

In this embodiment, to suppress the deterioration in the accuracy of the region restriction control due to variations (individual differences) in the opening characteristic table To caused by manufacturing errors of the flow control valve D3, which corresponds to the boom raise operation among the flow control valves D1 to D6, the learning section 149 learns the relationship between the opening area of the meter-out passage section of the flow control valve D3 and the operating pressure generated by the solenoid valve 56*a*. The learning section 149, based on the learning results, refers to the opening characteristic table To and corrects the target operating pressure PiBM3U1 calculated based on the target spool opening, thereby suppressing the deterioration of area restriction control accuracy due to variations in manufacturing errors.

To learn the relationship between the opening area of the meter-out passage part of flow control valve D3 and the operating pressure generated by solenoid valve 56*a*, the load pressure on the meter-out side of hydraulic cylinder 5 is measured.

In this embodiment, the load pressure on the meter-out side of hydraulic cylinder 5 is related to the opening area of the meter-out passage part of flow control valve D3 and the operating pressure generated by solenoid valve 56*a*. As the operating pressure generated by solenoid valve 56*a* increases, the opening area of the meter-out passage part of flow control valve D3 becomes larger.

As the opening area of the meter-out passage part of flow control valve D3 becomes larger, the pressure loss (brake pressure) due to the restriction of the meter-out opening decreases, and the load pressure on the meter-out side of hydraulic cylinder 5 becomes smaller.

Conversely, as the operating pressure generated by solenoid valve 56*a* decreases, the opening area of the meter-out passage part of flow control valve D3 becomes smaller. As the opening area of the meter-out passage part of flow control valve D3 becomes smaller, the pressure loss (brake pressure) due to the restriction of the meter-out opening increases, and the load pressure on the meter-out side of hydraulic cylinder 5 becomes larger.

Therefore, by measuring the load pressure on the meter-out side of hydraulic cylinder 5, the pressure loss (brake pressure) due to the restriction can be measured, and the relationship between the opening area of the meter-out passage part of flow control valve D3 and the operating pressure generated by solenoid valve 56*a* can be learned. As a method for measuring the pressure loss (brake pressure) due to the restriction, there is a method of directly detecting the load pressure on the meter-out side of hydraulic cylinder 5, as well as a method of multiplying the load pressure on the meter-in side of hydraulic cylinder 5 by the pressure receiving area ratio of hydraulic cylinder 5.

Referring to FIG. 9, the flow of the learning process for flow control valve D3 executed by learning section 149 will be described. FIG. 9 is a flowchart showing the learning process for flow control valve D3 executed by learning section 149. When the external input device 96 is operated by the operator and the execution command for the learning process is input from the external input device 96, the learning section 149 starts the learning process (step S101).

In step S101, the learning section 149 reads the learning start posture data and learning start target surface data associated with the learning of flow control valve D3 from non-volatile memory 42.

FIG. 10 is a diagram showing the learning start posture and learning start target surface corresponding to flow control valve D3. In non-volatile memory 42, the learning start posture data defining the learning start posture shown in FIG. 10 and the learning start target surface data are stored.

The learning start posture data includes the target range (lower limit and upper limit) that satisfies the target angle of boom angle α, the target range (lower limit and upper limit) that satisfies the target angle of arm angle β, and the target range (lower limit and upper limit) that satisfies the target angle of bucket angle γ. The learning start target surface data includes the target range (lower limit and upper limit) in the Z-axis direction of the excavator reference coordinate system of working device 1A for the excavation target surface St, and the target angle (lower limit and upper limit) between the excavation target surface St and the X-axis of the excavator reference coordinate system of working device 1A.

In this embodiment, as shown in FIG. 10, to set the start posture and target surface for leveling, the arm angle β of the learning start posture data is set to the angle where arm cylinder 6 is most shrank, and the bucket angle γ is set to a range where 0 degrees is the target angle. The learning start target surface data is parallel to the X-axis of the excavator reference coordinate system of working device 1A, and the target range in the Z-axis direction is set so that the tip of bucket 10 is in an aerial operation. When the arm angle β and the bucket angle γ satisfy the above target range at the target angle of the boom angle α, and the tip of the bucket 10 coincides with the target surface, the target range is set by the target angle of the boom angle α.

Once the reading of the learning start posture data and learning start target surface data is completed in step S101, proceed to step S102. In step S102, as shown in FIG. 9, the display control section 150 causes the display device 53 to display the learning start posture screen 53*a* (see FIG. 11). As shown in FIG. 11, the learning start posture screen 53*a* displays a message prompting the operator to perform an operation to set the posture of the working device 1A to the learning start posture: "Please adjust the posture of the working device to the target range."

In step S102 of FIG. 9, when the learning start posture screen 53*a* is displayed on the display device 53, the process proceeds to step S103. In step S103, a determination is made as to whether the learning start conditions (learning start posture, learning start target surface, MC execution mode setting) are satisfied.

The determination of the learning start posture is a determination of whether the posture of the working device 1A is the learning start posture. If each of the current boom angle α, arm angle β, and bucket angle γ is within the target range, the learning section 149 determines that the posture of the working device 1A is the learning start posture. If any of the current boom angle α, arm angle β, and bucket angle γ is outside the target range, the learning section 149 determines that the posture of the working device 1A is not the learning start posture.

The determination of the learning start target surface is a determination of whether the excavation target surface St is the learning start target surface. If the excavation target surface St is within the target range defined by the learning start target surface data, the learning section 149 determines that the excavation target surface St is the learning start target surface. If the excavation target surface St is outside the target range defined by the learning start target surface data, the learning section 149 determines that the excavation target surface St is not the learning start target surface.

The determination of the MC execution mode setting is a determination of whether it is set to the mode for executing the MC. If it is set to the mode for executing the MC by the mode switch operated by the operator, the learning section 149 determines that it is set to the mode for executing the MC. If it is not set to the mode for executing the MC by the mode switch operated by the operator, the learning section 149 determines that it is not set to the mode for executing the MC.

In step S103, if all the learning start conditions (learning start posture, learning start target surface, MC execution mode setting) are positively determined, the process proceeds to step S104. The determination of the learning start conditions (learning start posture, learning start target surface, MC execution mode setting) in step S103 is repeatedly executed at a predetermined control cycle until a positive determination is made.

In step S103, if the determination process of the learning start conditions is positively determined, the display control section 150 causes the display device 53 to display an operation instruction screen. The operation instruction screen displays operation instructions such as ""Please operate the arm control lever to the roll-in side."" In step S103, when the operation instruction screen is displayed, the process proceeds to step S104.

In step S104, when the electric operation lever device A2 is operated to the arm roll-in side by the operator, the learning process is started. Also, while the electric operation lever device A2 is being operated, area restriction control is executed, and the operation of the working device 1A is controlled so that the tip of the bucket 10 moves along the excavation target surface St.

The learning section 149 performs area restriction control and measures the load pressure on the meter-out side of the hydraulic cylinder 5 when the boom 8 is driven in the upward direction. Hereinafter, the load pressure on the meter-out side of the hydraulic cylinder 5 is also referred to as cylinder pressure. The learning section 149 stores the measured cylinder pressure and time. Here, the stored cylinder pressure is detected by the pressure sensor 5*a*.

FIG. 12 is a diagram showing the relationship between the time stored during the measurement of the cylinder pressure and the cylinder pressure. In step S104, the learning section 149 calculates the minimum value Pmin of the cylinder pressure (hereinafter also referred to as the minimum cylinder pressure) and the maximum value Pmax (hereinafter also referred to as the maximum cylinder pressure) based on the stored time and the cylinder pressure measured using the pressure sensor 5*a*, and proceeds to step S105.

In step S105, the learning section 149 determines whether the minimum cylinder pressure Pmin calculated in step S104 is equal to or greater than the predetermined minimum threshold value Pm1 of the cylinder pressure. The minimum threshold value Pm1 of the cylinder pressure is set as the target value for the cylinder pressure, which is calculated theoretically based on the pre-stored opening properties and the flow passing through the flow control valve D3 during area restriction control, or determined through experiments using a prototype machine. The minimum threshold value Pm1 is the lower limit value when setting the target range (lower limit and upper limit) that satisfies the target value.

In step S105, if the minimum cylinder pressure Pmin is determined to be less than the minimum threshold value Pm1 of the cylinder pressure, the learning section 149 proceeds to step S107.

In step S107, the learning section 149 subtracts the correction value Pic of the operating pressure and obtains a correction value Pic that lowers the operating pressure. For example, if the initial value of the correction value Pic is set to 1.00, to lower the operating pressure, 0.01 is subtracted from the initial value to make the correction value Pic 0.99.

The learning section 149 outputs the obtained correction value Pic to the correction target pressure calculation section and returns the process to step S102. That is, at the next measurement of the cylinder pressure, the target operating pressure PiBM3U1 is corrected by the correction target pressure calculation section 146, and the correction target operating pressure PiBM3U2 is output to the valve command calculation section 147. The correction method in the correction target pressure calculation section 146 will be described later.

In step S105, if the minimum cylinder pressure Pmin is determined to be greater than the minimum threshold value Pm1 of the cylinder pressure, the learning section 149 proceeds to step S106.

In step S106, the learning section 149 determines whether the maximum cylinder pressure Pmax calculated in step S104 is equal to or less than the predetermined maximum threshold value Pm2 of the cylinder pressure. The maximum threshold value Pm2 of the cylinder pressure is set as the target value for the cylinder pressure, which is calculated theoretically based on the pre-stored opening properties and the flow passing through the flow control valve D3 during area restriction control, or determined through experiments using a prototype machine. The maximum threshold value Pm2 is the upper limit value when setting the target range (lower limit and upper limit) that satisfies the target value.

In step S106, if the maximum cylinder pressure Pmax is determined to be greater than the maximum threshold value Pm2 of the cylinder pressure, the learning section 149 proceeds to step S108.

In step S108, the learning section 149 adds the correction value Pic of the operating pressure and obtains a correction value Pic that increases the operating pressure. For example, if the initial value of the correction value Pic is set to 1.00, to increase the operating pressure, 0.01 is added to the initial value to make the correction value Pic 1.01.

The learning section 149 outputs the obtained correction value Pic to the correction target pressure calculation section and returns the process to step S102. That is, at the next measurement of the cylinder pressure, the target operating pressure PiBM3U1 is corrected by the correction target pressure calculation section 146, and the corrected target operating pressure PiBM3U2 is output to the valve command calculation section 147. The correction method in the correction target pressure calculation section 146 will be described later.

In step S106, if the maximum cylinder pressure Pmax is determined to be less than the maximum threshold value Pm2 of the cylinder pressure, the learning section 149 proceeds to step S109. In step S109, the learning section 149 stores the correction value Pic of the operating pressure and ends the process shown in the flowchart of FIG. 9. The display control section 150 causes the display device 53 to display that the learning process has ended.

In this way, the learning section 149 measures the cylinder pressure during the execution of area restriction control in the learning process. Then, the learning section 149 obtains the correction value Pic of the operating pressure when it falls within the range of the pressure threshold Pta (minimum threshold value Pm1 of the cylinder pressure, maximum threshold value Pm2 of the cylinder pressure). The obtained correction value Pic is used in the correction process.

In this embodiment, as shown in FIG. 12, the measured cylinder pressure becomes smaller than the minimum cylinder pressure threshold Pm1 when the electric operation lever device A2 is operated by the operator towards the arm roll-in side, both immediately after the area restriction control is executed and near the end of the boom raise operation. If the measured cylinder pressure is smaller than the minimum threshold value Pm1 of the cylinder pressure, the flow from step S105 to step S107 in FIG. 9 is repeated.

Therefore, in this embodiment, a threshold value Vta is set for the secondary target speed calculated by the target speed calculation section 144, and the cylinder pressure is measured when the secondary target speed of the hydraulic cylinder 5 is equal to or greater than the threshold value Vta. In other words, by measuring the cylinder pressure except for the cylinder pressure immediately after the area restriction control is executed and near the end of the boom raise operation, the repetition of the flow from the incorrect step S105 to step S107 is prevented. Also, the condition for starting the measurement of the cylinder pressure does not have to be a threshold for the secondary target speed, as long as it can be measured excluding the cylinder pressure immediately after the area restriction control is executed and near the end of the boom raise operation.

The valve command calculation section 147 calculates an electrical signal based on the target operating pressure Pi1 (PiBM12U1, PiBM3U1, PiBM12D1, PiBM3D1, PiAM1C1, PiAM2C1, PiAM1D1, PiAM2D1, PiBKC1, PiBKD1) and the correction target pressure Pi2 calculated by the target pressure calculation section 145, and outputs the calculated electrical signal to the corresponding solenoid valves 55*a* to 59*b*. Also, the valve command calculation section 147 calculates an electrical signal based on the target regulator pressure PPc (PPC201, PPC202, PPc203) calculated by the target pressure calculation section 145, and outputs the calculated electrical signal to the regulator solenoid valves of the corresponding regulators 201*a* to 203*a*.

The solenoids of the solenoid valves 55*a* to 59*b* are energized by the electrical signal (excitation current) output from the valve command calculation section 147, causing the solenoid valves 55*a* to 59*b* to operate. Then, the operating pressure (pilot pressure) acting on the flow control valves D1 to D6 is controlled to the target operating pressure Pi1 calculated by the target pressure calculation section 145. This controls the operating speed of the hydraulic cylinders 5 to 7 to the target speed. Additionally, the solenoids of the regulator solenoid valves of regulators 201*a* to 203*a* are energized by the electrical signal (excitation current) output from the valve command calculation section 147, causing the regulator solenoid valves to operate. Then, the regulator pressure (pilot pressure) acting on the pressure receiving part of regulators 201*a* to 203*a* is controlled to the target regulator pressure PPc calculated by the target pressure calculation section 145. This controls the discharge flow rate of the main pumps 201 to 203 to the target flow rates Q201, Q202, Q203.

The correction process will be described with reference to FIG. 13. FIG. 13 shows the correction process performed by the target operating pressure PiBM3U1 is calculated by the target pressure calculation section 145, and the correction value Pic is obtained from the learning section 149. The correction target pressure calculation section 146 receives the target operating pressure PiBM3U1 calculated by the target pressure calculation section 145 and reads the correction value Pic obtained from the learning section 149. In this embodiment, to perform the learning process for the flow control valve D3, the target pressure calculation section 145 outputs the target operating pressure PiBM3U1 corresponding to the flow control valve D3 to the correction target pressure calculation section 146 during the correction process. The target operating pressure output from the target pressure calculation section 145 to the valve command calculation section 147 is the target operating pressure Pi1

(PiBM12U1, PiBM12D1, PiBM3D1, PiAM1C1, PiAM2C1, PiAM1D1, PiAM2D1, PiBKC1, PiBKD1) excluding the target operating pressure PiBM3U1.

The correction target pressure calculation section 146 calculates the correction target operating pressure PiBM3U2 by multiplying the target operating pressure PiBM3U1 by the correction value Pic and outputs it to the valve command calculation section 147.

As described above, the controller 40 according to this embodiment calculates the target spool opening on the meter-out side of the flow control valves D1 to D6 based on the target speed of the hydraulic cylinders 5 to 7 and the detection results of the pressure sensors 5*a* to 7*b*, 201*b* to 203*b*. Then, the controller 40 refers to the opening characteristic table To and calculates the target operating pressure based on the target spool opening.

Furthermore, the learning section 149 performs a learning process for the flow control valve D3, and calculates the correction target operating pressure using the correction values obtained from the learning process.

The controller 40 controls the solenoid valves 55*a* to 59*b* so that the operating pressure generated by the solenoid valves 55*a* to 59*b* becomes the target operating pressure and the correction target operating pressure.

By calculating the target operating pressure and the correction target operating pressure in this way, even if the load pressure (hydraulic load condition) of the hydraulic cylinder changes, the target opening area corresponding to that load pressure can be determined. In addition, by performing the learning process and the correction process, the target operating pressure corresponding to the manufacturing error variation of the flow control valve D3 can be determined. Therefore, even if an open center system is adopted in the hydraulic system, the hydraulic cylinders 5 to 7 can be operated accurately at the calculated target flow rate (target speed), and the deterioration in the accuracy of the area restriction control due to the manufacturing error variation of the flow control valve D3 can be suppressed. As a result, operations by MC such as area restriction control can be performed accurately.

It is preferable to perform the above learning process when the spool stroke of the flow control valve D3 has changed to some extent from the factory-shipped characteristics due to aging deterioration of the flow control valve D3, such as when replacing the spool. This allows MC to be performed accurately over a long period.

According to the first embodiment described above, the following operational effects are achieved.

(1) The target pressure calculation section 145 calculates the target value (target operating pressure) Pi1 of the operating pressure generated by the solenoid valves 55*a* to 59*b* based on the opening characteristic table To, the target spool opening (Aout in this embodiment), and the operating pressure Pi0. The target pressure calculation section 145 according to this embodiment outputs PiBM3U1 of the target operating pressure Pi1 to the correction target pressure calculation section 146.

The correction target pressure calculation section 146 calculates the correction target operating pressure PiBM3U2 based on the target operating pressure PiBM3U1 and the correction value Pic obtained by the learning process of the learning section 149. The valve command calculation section 147 controls the solenoid valves 55*a* to 59*b* based on the correction target operating pressure PiBM3U2 and the target operating pressure Pi1 excluding the target operating pressure PiBM3U1.

The learning section 149 measures the cylinder pressure of the flow control valve D3 while the area restriction control is being executed. Then, the learning section 149 executes a learning process to obtain the correction value Pic of the operating pressure when the measured cylinder pressure (minimum cylinder pressure Pmin, maximum cylinder pressure Pmax) falls within the predetermined pressure threshold Pta.

In the learning process, by measuring the cylinder pressure (minimum cylinder pressure Pmin, maximum cylinder pressure Pmax) and obtaining the correction value Pic of the operating pressure so that it falls within the predetermined pressure threshold range Pta, it is possible to keep the pressure drop (brake pressure) caused by the restriction of the meter-out opening within the target range.

According to this configuration, through learning and correction, the impact of manufacturing errors of the flow control valve D3 can be reduced, and by reproducing the opening characteristics of the flow control valve used in the prototype machine in advance, it is possible to control the flow control valve. As a result, in area restriction control and the like, the tip (control point) of the bucket 10 can be moved accurately.

The hydraulic system may be a closed center system or an open center system as shown in FIG. 14. The controller 40 according to this embodiment calculates the target opening area using the orifice equation, taking into account the target flow rate (target speed) and the load pressure of the hydraulic cylinders 5 to 7, when it is desired to operate the hydraulic cylinders 5 to 7 at a predetermined target flow rate (target speed). Therefore, even if an open center system is adopted in the hydraulic system, the hydraulic cylinders 5 to 7 can be operated at the target flow rate (target speed) regardless of light or heavy load.

Thus, according to this embodiment, variations in the operation of the hydraulic cylinders due to individual differences in the work machine are suppressed regardless of the configuration of the hydraulic system, enabling the provision of a work machine capable of performing work with high precision.

(2) The learning section 149 considers the posture of the working device 1A being the learning start posture, or the excavation target surface St being the learning start target surface, as at least one of the conditions for starting the learning process. This allows the learning section 149 to appropriately obtain the correction value Pic, and the correction target pressure calculation section 146 to accurately correct the target operating pressure Pi1.

The work machine 1 of the first embodiment includes a vehicle body 1B, a working device 1A rotatably attached to the vehicle body 1B, a hydraulic cylinder 5 for driving the working device 1A, an operating device A1 for operating the working device 1A, a hydraulic pump 203, a flow control valve D3 for controlling the flow rate of hydraulic oil supplied from the hydraulic pump 203 to the hydraulic cylinder 5, and solenoid valves 56*a*, 56*b* for generating the operating pressure of the flow control valve D3. The controller 40 calculates the target speed of the hydraulic cylinder 5 so that the operating range of the working device 1A is limited to the target surface St and above based on the operation amount of the operating device A1, calculates the target operating pressure of the flow control valve D3 based on the target speed, and controls the solenoid valves 56*a*, 56*b* according to the target operating pressure. The work machine 1 further includes pressure sensors 5*a*, 5*b* for measuring the meter-out pressure of the hydraulic cylinder 5, and the controller 40 calculates the correction value Pic of the target operating pressure to keep the measured meter-out pressure within the range from the predetermined first lower limit value Pm1 to the predetermined first upper limit value Pm2 while driving the hydraulic cylinder 5 to perform a predetermined operation on the working device 1A, and corrects the target operating pressure according to the correction value Pic.

Also, if the minimum value Pmin of the meter-out pressure measured while the working device 1A is performing the predetermined operation falls below the first lower limit value Pm1, the controller 40 in the first embodiment calculates a correction value Pic so that the target operating pressure decreases. Then, if the maximum value Pmax of the meter-out pressure measured while the working device 1A is performing the predetermined operation exceeds the first upper limit value Pm2, the controller 40 calculates a correction value Pic so that the target operating pressure increases, and corrects the target operating pressure by increasing or decreasing the target operating pressure according to the correction value Pic.

According to the first embodiment configured as described above, the target operating pressure of the flow control valve D3 can be corrected so that the meter-out pressure of the hydraulic cylinder 5 driving the working device 1A falls within the predetermined range (Pm1 to Pm2). As a result, deterioration in the speed response of the hydraulic cylinder 5 driving the working device 1A, as well as surging and deviation of the hydraulic cylinder 5, can be prevented, enabling work to be performed with high precision.

In the first embodiment, the pressure sensor 5*b* detects the meter-in pressure of the hydraulic cylinder 5, and the controller 40 calculates the measurement value of the meter-out pressure by multiplying the meter-in pressure detected by the pressure sensor 5*b* by the pressure receiving area ratio of the hydraulic cylinder 5. This makes it possible to measure the meter-out pressure of the hydraulic cylinder 5 even if the pressure sensor 5*a* for detecting the meter-out pressure of the hydraulic cylinder 5 is not provided.

Embodiment 2

The second embodiment of the present invention will be described, focusing on the differences from the first embodiment. In the first embodiment, learning processing is performed for the leveling operation, but in this embodiment, learning processing is performed for the boom raise single operation.

FIG. 15 is a flowchart showing the learning process executed by the learning section 149 according to this embodiment, and FIG. 16 shows the learning start posture according to this embodiment.

In this embodiment, as shown in FIG. 16, the arm cylinder 6 and the bucket cylinder 7 are at their maximum extension, and the boom angle where the working device 1A does not contact the ground is stored as the boom raise single learning start posture. Then, the cylinder pressure during the boom raise single operation is measured, and a correction value is obtained by comparing the measured cylinder pressure with a threshold.

Referring to FIG. 15, the learning process for the flow control valve D3 during the boom raise single operation will be described. When the external input device 96 is operated by the operator and a command to execute the learning process is input from the external input device 96, the learning section 149 starts the learning process (step S201).

In step S201, when the reading of the boom raise single learning start posture data is completed, the process proceeds to step S202.

In step S202, the display control section 150 displays the boom raise single learning start posture on the display device 53, as shown in FIG. 16, and proceeds to step S203.

In step S203, the learning section 149 determines whether the posture of the working device 1A is the learning start posture. If each of the current boom angle α, arm angle β, and bucket angle γ is within the target range defined by the boom raise single learning start posture data, the learning section 149 determines that the posture of the working device 1A is the learning start posture and proceeds to step S204.

If at least one of the current boom angle α, arm angle β, and bucket angle γ is outside the target range defined by the boom raise single learning start posture data, the learning section 149 determines that the posture of the working device 1A is not the learning start posture. The learning start condition determination process in step S203 is repeatedly executed at a predetermined control cycle until a positive determination is made.

In step S203, if the learning start condition determination process is positively determined, the display control section 150 causes the display device 53 to display an operation instruction screen. The operation instruction screen displays instructions such as ""Please operate the boom control lever to the raise side."" In step S203, when the operation instruction screen is displayed, the process proceeds to step S204.

In step S204, when the electric operation lever device A1 is operated to the boom raise side by the operator, the learning process is started. Then, while the electric operation lever device A1 is being operated, the boom 8 operates to the raise side. Normally, when the electric operation lever device A1 is operated, the flow rate of hydraulic oil discharged from the three main pumps 201, 202, and 203 is controlled by the three flow control valves D1, D2, and D3, and the boom cylinder 5 is driven. However, since this embodiment focuses on learning the flow control valve D3, in the learning process, when the electric operation lever device A1 is operated, a command is given only to the solenoid valve 56*a*, and the flow rate of hydraulic oil discharged from the third main pump 203 is controlled by the flow control valve D3, and the boom cylinder 5 is driven.

The learning section 149 measures the cylinder pressure when the boom 8 is driven in the raising direction. The learning section 149 stores the measured cylinder pressure and time. Here, the stored cylinder pressure is detected by the pressure sensor 5*a*.

In step S204, the learning section 149 extracts the minimum value Pmin (hereinafter also referred to as the minimum cylinder pressure) and the maximum value Pmax (hereinafter also referred to as the maximum cylinder pressure) of the cylinder pressure from the start to the end of the measurement based on the stored time and the cylinder pressure measured using the pressure sensor 5*a*, and proceeds to step S205.

Thus, in this embodiment, the cylinder pressure is measured during the boom raise single operation. Then, it is determined whether the measured cylinder pressure is within the predetermined pressure threshold Ptab (minimum and maximum threshold values of cylinder pressure in boom single operation) for the boom single operation, and a correction value is obtained. In addition, the range of the pressure threshold Ptab for the cylinder pressure during the boom raise single operation learning is targeted at the cylinder pressure calculated theoretically based on the pre-stored opening characteristics and the flow passing through the flow control valve D3 during area restriction control, or the cylinder pressure determined through experiments using a prototype machine. Then, the range of the pressure threshold Ptab is set as a target range (lower limit and upper limit) that satisfies the target.

The working device 1A in the second embodiment includes a boom 8 rotatably attached to the vehicle body 1B, an arm 9 rotatably attached to the tip of the boom 8, and a bucket 10 rotatably attached to the tip of the arm 9. The hydraulic cylinder 5 that drives the working device 1A is the boom cylinder 5 that drives the boom 8. The predetermined operation to be performed by the working device 1A to calculate the correction value of the target operating pressure of the flow control valve D3 is the boom raise single operation that raises the boom 8 without operating the arm 9 or the bucket 10.

According to the second embodiment configured as described above, by measuring the cylinder pressure during the boom raise single operation, the start conditions for the learning process are reduced, efficiency is improved, and it becomes possible to execute the learning process even in environments where the arm cylinder 6 cannot be fully shrank.

Embodiment 3

The third embodiment of the present invention will be described, focusing on the differences from the first embodiment. In the first embodiment, the learning process targeting the flow control valve D3 corresponding to the boom raise operation was described. In contrast, this embodiment describes the learning process targeting the flow control valve D4 corresponding to the arm roll-in operation.

In this embodiment, among the flow control valves D1 to D6, to suppress the deterioration of the accuracy of region restriction control due to variations (individual differences) in the opening characteristic table To caused by manufacturing errors of the flow control valve D4 corresponding to the arm roll-in operation, the learning section 149 learns the relationship between the opening area of the flow control valve D4 and the operating pressure generated by the solenoid valve 57*a*. Based on the learning results, the learning section 149 refers to the opening characteristic table To and corrects the target operating pressure PiAM1C1 calculated based on the target spool opening, thereby suppressing the deterioration of the accuracy of region restriction control due to variations in manufacturing errors.

To learn the relationship between the opening area of the meter-out passage section of the flow control valve D4 and the operating pressure generated by the solenoid valve 57*a*, it is necessary to measure the load pressure on the meter-out side of the hydraulic cylinder 6.

The load pressure on the meter-out side of the hydraulic cylinder 6 in this embodiment is related to the opening area of the meter-out passage section of the flow control valve D4 and the operating pressure generated by the solenoid valve 57*a*.

Therefore, by measuring the load pressure on the meter-out side of the hydraulic cylinder 6, it is possible to measure the pressure loss (brake pressure) due to aperture, and learn the relationship between the opening area of the meter-out passage section of the flow control valve D4 and the operating pressure generated by the solenoid valve 57*a*. As a method for measuring the pressure loss (brake pressure) due to aperture, there is a method of directly detecting the load pressure on the meter-out side of the hydraulic cylinder 6, and a method of multiplying the load pressure on the meter-in side of the hydraulic cylinder 6 by the pressure receiving area ratio of the hydraulic cylinder 6.

Referring to FIG. 17, the flow of the learning process for the flow control valve D4 executed by the learning section 149 will be described. FIG. 17 is a flowchart showing the learning process for the flow control valve D4 executed by the learning section 149. When the external input device 96 is operated by the operator and a command to execute the learning process is input from the external input device 96, the learning section 149 starts the learning process (step S301). In step S301, the learning section 149 reads the learning start posture data and learning start target surface data associated with the learning of the flow control valve D4 from the non-volatile memory 42.

In this embodiment, as shown in FIG. 10, the start posture and target surface for the leveling are set. The arm angle β of the learning start posture data is set to the angle at which the arm cylinder 6 is fully shrank, and the bucket angle γ is set to a range where 0 degrees is the target angle. Then, the learning start target surface data is parallel to the X-axis of the excavator reference coordinate system of the working device 1A, and the target range in the Z-axis direction is set so that the tip of the bucket 10 is in an air operation. In addition, the target angle of the boom angle α is the angle of the boom angle α when the arm angle β and the bucket angle γ meet the above target range, and the tip of the bucket 10 aligns with the target surface. Then, the target range is set based on the target angle of the boom angle α.

In step S301, when the reading of the learning start posture data and learning start target surface data is completed, the process proceeds to step S302. In step S302, as shown in FIG. 17, the display control section 150 causes the display device 53 to display the learning start posture screen 53*a* (see FIG. 11). As shown in FIG. 11, the learning start posture screen 53*a* displays a message prompting the operator to adjust the posture of the working device 1A to the learning start posture: "Please adjust the posture of the working device to the target range."

In step S302 of FIG. 17, when the learning start posture screen 53*a* is displayed on the display device 53, the process proceeds to step S303. In step S303, it is determined whether the learning start conditions (learning start posture, learning start target surface, MC execution mode setting) are satisfied.

The determination of the learning start posture is a determination of whether the posture of the working device 1A is the learning start posture. If each of the current boom angle α, arm angle β, and bucket angle γ is within the specified target range, the learning section 149 determines that the posture of the working device 1A is the learning start posture. If any of the current boom angle α, arm angle β, or bucket angle γ is outside the target range, the learning section 149 determines that the posture of the working device 1A is not the learning start posture.

The determination of the learning start target surface is a determination of whether the excavation target surface St is the learning start target surface. If the excavation target surface St is within the target range specified by the learning start target surface data, the learning section 149 determines that the excavation target surface St is the learning start target surface. If the excavation target surface St is outside the target range specified by the learning start target surface data, the learning section 149 determines that the excavation target surface St is not the learning start target surface.

The determination of the MC execution mode setting is a determination of whether it is set to the mode for executing the MC. If it is set to the mode for executing the MC by the mode switch operated by the operator, the learning section 149 determines that it is set to the mode for executing the MC. If it is not set to the mode for executing the MC by the mode switch operated by the operator, the learning section 149 determines that it is not set to the mode for executing the MC.

In step S303, if all the learning start conditions (learning start posture, learning start target surface, MC execution mode setting) are positively determined, the process proceeds to step S304. The determination of the learning start conditions (learning start posture, learning start target surface, MC execution mode setting) in step S303 is repeatedly executed at a predetermined control cycle until a positive determination is made.

In step S303, if the determination process of the learning start conditions is positively determined, the display control section 150 causes the display device 53 to display the operation instruction screen. The operation instruction screen displays operation instructions such as ""Please operate the arm control lever to the roll-in side."" In step S303, when the operation instruction screen is displayed, the process proceeds to step S304.

In step S304, when the electric operation lever device A2 is operated to the arm roll-in side by the operator, the learning process is started. While the electric operation lever device A2 is being operated, area restriction control is executed, and the operation of the working device 1A is controlled so that the tip of the bucket 10 moves along the excavation target surface St.

The learning section 149 executes area restriction control and measures the load pressure on the meter-out side of the hydraulic cylinder 6 when the arm 9 is driven in the arm roll-in direction. Hereinafter, the load pressure on the meter-out side of the hydraulic cylinder 6 is also referred to as the arm cylinder pressure. The learning section 149 stores the measured arm cylinder pressure and time. Here, the stored arm cylinder pressure is detected by the pressure sensor 6*a*.

In step S304, the learning section 149 extracts the minimum value Pamin (hereinafter also referred to as the minimum arm cylinder pressure) and the maximum value Pamax (hereinafter also referred to as the maximum arm cylinder pressure) of the arm cylinder pressure from the start to the end of the measurement based on the stored time and the arm cylinder pressure measured using the pressure sensor 6*a*, and proceeds to step S305.

In step S305, the learning section 149 determines whether the minimum arm cylinder pressure Pamin calculated in step S304 is equal to or greater than the predetermined minimum threshold value Pm3 of the arm cylinder pressure. In addition, the minimum threshold value Pm3 of the arm cylinder pressure is targeted at the cylinder pressure calculated theoretically based on the pre-stored opening characteristics and the flow passing through the flow control valve D4 during area restriction control, or the cylinder pressure determined through experiments using a prototype machine. The minimum threshold value Pm3 is the lower limit value when the target range (lower limit and upper limit) satisfying the target value is set.

In step S305, if the minimum arm cylinder pressure Pamin is determined to be smaller than the minimum threshold value Pm3 of the arm cylinder pressure, the learning section 149 proceeds to step S307.

In step S307, the learning section 149 subtracts the correction value Pica (hereinafter also referred to as the arm correction value) of the target operating pressure of the hydraulic cylinder 6 and obtains an arm correction value Pica that lowers the operating pressure. For example, if the initial value of the correction value Pica is set to 1.00, to lower the operating pressure, 0.01 is added to the initial value to make the correction value Pica 1.01.

The learning section 149 outputs the obtained arm correction value Pica to the correction target pressure calculation section and returns the process to step S302. That is, at the next measurement of the arm cylinder pressure, the target operating pressure PiAM1C1 is corrected by the correction target pressure calculation section 146, and the corrected target operating pressure PiAM1C2 is output to the valve command calculation section 147. In addition, the correction method in the correction target pressure calculation section 146 will be described later.

In step S305, if the minimum arm cylinder pressure Pamin is determined to be greater than the minimum threshold value Pm3 of the arm cylinder pressure, the learning section 149 proceeds to step S306.

In step S306, the learning section 149 determines whether the maximum arm cylinder pressure Pamax calculated in step S304 is equal to or less than the predetermined maximum threshold value Pm4 of the arm cylinder pressure. In addition, the maximum threshold value Pm4 of the arm cylinder pressure is targeted at the cylinder pressure calculated theoretically based on the pre-stored opening characteristics and the flow passing through the flow control valve D4 during area restriction control, or the cylinder pressure determined through experiments using a prototype machine. The maximum threshold value Pm4 is the upper limit value when the target range (lower limit and upper limit) satisfying the target value is set.

In step S306, if the maximum arm cylinder pressure Pamax is determined to be greater than the maximum threshold value Pm4 of the cylinder pressure, the learning section 149 proceeds to step S308.

In step S308, the learning section 149 adds the correction value Pica of the operating pressure and obtains an arm correction value Pica that increases the operating pressure. For example, if the initial value of the correction value Pic is set to 1.00, to increase the operating pressure, 0.01 is added to the initial value to make the correction value Pic 1.01.

The learning section 149 outputs the obtained arm correction value Pica to the correction target pressure calculation section and returns the process to step S302. That is, at the next measurement of the cylinder pressure, the target operating pressure PiAM1C1 is corrected by the correction target pressure calculation section 146, and the correction target operating pressure PiAM1C2 is output to the valve command calculation section 147. The correction method in the correction target pressure calculation section 146 will be described later.

In step S306, if the maximum arm cylinder pressure Pamax is determined to be smaller than the maximum threshold value Pm4 of the arm cylinder pressure, the learning section 149 proceeds to step S309. In step S309, the learning section 149 stores the arm correction value Pica of the operating pressure and ends the process shown in the flowchart of FIG. 9. The display control section 150 causes the display device 53 to display that the learning process has ended.

In this way, the learning section 149 measures the arm cylinder pressure during the execution of area restriction control in the learning process and obtains the arm correction value Pica when it falls within the range of the pressure threshold Ptaa (minimum threshold Pm3 and maximum threshold Pm4 of the arm cylinder pressure). The obtained arm correction value Pica is used in the correction process.

In this embodiment, as shown in FIG. 12, the measured arm cylinder pressure is operated to the arm roll-in side by the electric operation lever device A2 by the operator. Then, immediately after the area restriction control is executed and near the end of the arm roll-in operation, the arm cylinder pressure becomes smaller than the minimum threshold value Pm3 of the arm cylinder pressure. If the measured arm cylinder pressure is smaller than the minimum threshold value Pm3 of the arm cylinder pressure, the flow from step S305 to step S307 in FIG. 17 is repeated.

In this embodiment, a threshold value Vtaa is set for the secondary target speed calculated by the target speed calculation section 144, and the cylinder pressure is measured when the secondary target speed of the hydraulic cylinder 6 is equal to or greater than the threshold value Vtaa. That is, by measuring the arm cylinder pressure except immediately after the area restriction control is executed and near the end of the arm roll-in operation, the repetition of the flow from the incorrect step S305 to step S307 is prevented. In addition, the condition for starting the measurement of the arm cylinder pressure does not have to be a threshold for the secondary target speed, as long as it can be measured except immediately after the area restriction control is executed and near the end of the boom raise operation.

The correction process will be described with reference to FIG. 18. FIG. 18 shows the correction process performed by the target operating pressure PiAM1C1 is calculated by the target pressure calculation section 145, and the arm correction value Pica is obtained from the learning section 149. The correction target pressure calculation section 146 receives the target operating pressure PiAM1C1 output from the target pressure calculation section 145 and reads the arm correction value Pica obtained by the learning section 149. In this embodiment, to perform the learning process for the flow control valve D4, during the correction process, the target pressure calculation section 145 outputs the target operating pressure PiAM1C1 corresponding to the flow control valve D4 to the correction target pressure calculation section 146. The target operating pressure output from the target pressure calculation section 145 to the valve command calculation section 147 is the target operating pressure Pi1 (PiBM12U1, PiBM3U1, PiBM12D1, PiBM3D1, PiAM2C1, PiAM1D1, PiAM2D1, PiBKC1, PiBKD1) excluding the target operating pressure PiAM1C1.

The correction target pressure calculation section 146 calculates the correction target operating pressure Pi2 by multiplying the target operating pressure PiAM1C1 by the arm correction value Pica and outputs it to the valve command calculation section 147.

According to the third embodiment described above, the following effects are achieved.

(1) The target pressure calculation section 145 calculates the target value of the operating pressure (target operating pressure) Pi1 generated by the solenoid valves 55*a* to 59*b* based on the opening characteristic table To, the target spool opening (Aout in this embodiment), and the operating pressure Pi0. The target pressure calculation section 145 according to this embodiment outputs PiAM1C1 of the target operating pressure Pi1 to the correction target pressure calculation section 146.

The correction target pressure calculation section 146 calculates the correction target operating pressure PiAM1C2 based on the target operating pressure PiAM1C1 and the arm correction value Pica obtained by the learning process of the learning section 149. The valve command calculation section 147 controls the solenoid valves 55*a* to 59*b* based on the correction target operating pressure PiAM1C2 and the target operating pressure Pi1 excluding the target operating pressure PiAM1C1.

The learning section 149 measures the arm cylinder pressure of the flow control valve D4 while the area restriction control is being executed. Then, the learning section 149 executes a learning process to obtain the arm correction value Pica when the measured arm cylinder pressure (minimum arm cylinder pressure Pamin, maximum arm cylinder pressure Pamax) falls within the predetermined pressure threshold Ptaa (minimum cylinder pressure threshold Pm3, maximum cylinder pressure threshold Pm4).

In the learning process, by measuring the cylinder pressure (minimum arm cylinder pressure Pamin, maximum arm cylinder pressure Pamax) and obtaining the correction value Pica of the operating pressure so that it falls within the predetermined pressure threshold Ptaa, the pressure loss (brake pressure) due to the aperture of the meter-out opening can be kept within the target range.

According to this configuration, through learning and correction, the impact of manufacturing errors of the flow control valve D4 can be reduced, and by reproducing the opening characteristics of the flow control valve used in the prototype machine in advance, it is possible to control the flow control valve. As a result, in area restriction control and the like, the tip (control point) of the bucket 10 can be moved with high precision.

In addition, the hydraulic system may be a closed center system or, as shown in FIG. 14, an open center system. The controller 40 according to this embodiment calculates the target opening area using the orifice equation that considers the target flow rate (target speed) and the load pressure of the hydraulic cylinders 5 to 7 when it is desired to operate the hydraulic cylinders 5 to 7 at a predetermined target flow rate (target speed). Therefore, even if an open center system is adopted in the hydraulic system, the hydraulic cylinders 5 to 7 can be operated according to the target flow rate (target speed) regardless of light or heavy load.

Thus, according to this embodiment, variations in the operation of the hydraulic cylinders due to individual differences in the work machine are suppressed regardless of the configuration of the hydraulic system, enabling the provision of a work machine capable of performing work with high precision.

(2) The learning section 149 considers the posture of the working device 1A being the learning start posture, or the excavation target surface St being the learning start target surface, as at least one of the conditions for starting the learning process. This allows the learning section 149 to appropriately obtain the arm correction value Pica, and the correction target pressure calculation section 146 to accurately correct the target operating pressure Pi1.

Furthermore, if the learning process of the third embodiment is performed after the learning process of the first or second embodiment, it is possible to suppress the deterioration in the accuracy of the area restriction control due to the manufacturing errors of the flow control valves D4 and D5 corresponding to the arm roll-in operation, in addition to the manufacturing errors of the flow control valve D3 corresponding to the boom raise operation, thereby providing a work machine capable of performing work with high precision. It is also possible to perform the learning process of the first or second embodiment after performing the learning process of the third embodiment.

The work machine 1 of the third embodiment includes a vehicle body 1B, a working device 1A rotatably attached to the vehicle body 1B, a hydraulic cylinder 6 for driving the working device 1A, an operating device A2 for operating the working device 1A, a hydraulic pump 202, a flow control valve D4 for controlling the flow rate of hydraulic oil supplied from the hydraulic pump 202 to the hydraulic cylinder 6, and solenoid valves 57*a*, 57*b* for generating the operating pressure of the flow control valve D4. The controller 40 calculates the target speed of the hydraulic cylinder 6 so that the operating range of the working device 1A is restricted to the target surface St and above, based on the operation amount of the operating device A2, calculates the target operating pressure of the flow control valve D4 based on the target speed, and controls the solenoid valves 57*a*, 57*b* according to the target operating pressure. The work machine 1 further includes pressure sensors 6*a*, 6*b* for measuring the meter-out pressure of the hydraulic cylinder 6, and the controller 40 calculates the correction value Pica of the target operating pressure to keep the measured meter-out pressure within the range from the predetermined first lower limit value Pm3 to the predetermined first upper limit value Pm4 while driving the hydraulic cylinder 6 to perform a predetermined operation on the working device 1A, and corrects the target operating pressure according to the correction value Pica.

Furthermore, in the third embodiment, if the minimum value Pmin of the meter-out pressure measured while the working device 1A is performing the predetermined operation falls below the first lower limit value Pm3, the controller 40 calculates the correction value Pica so that the target operating pressure decreases. If the maximum value Pmax of the meter-out pressure measured while the working device 1A is performing the predetermined operation exceeds the first upper limit value Pm4, the controller 40 calculates the correction value Pica so that the target operating pressure increases, and corrects the target operating pressure by increasing or decreasing it according to the correction value Pica.

According to the third embodiment configured as described above, the target operating pressure of the flow control valve D4 can be corrected so that the meter-out pressure of the hydraulic cylinder 6 driving the working device 1A falls within the predetermined range (Pm3 to Pm4). As a result, it is possible to prevent the deterioration of the speed responsiveness of the hydraulic cylinder 6 driving the working device 1A, as well as the surging and deviation of the hydraulic cylinder 6, enabling work to be performed with high precision.

Furthermore, in the third embodiment, the pressure sensor 6*b* detects the meter-in pressure of the hydraulic cylinder 6. The controller 40 calculates the measured value of the meter-out pressure by multiplying the meter-in pressure detected by the pressure sensor 6*b* by the pressure receiving area ratio of the hydraulic cylinder 6. This makes it possible to measure the meter-out pressure of the hydraulic cylinder 6 even if the pressure sensor 6*a* for detecting the meter-out pressure of the hydraulic cylinder 6 is not provided.

Furthermore, in the third embodiment, the working device 1A includes a boom 8 rotatably attached to the vehicle body 1B, an arm 9 rotatably attached to the tip of the boom 8, and a bucket 10 rotatably attached to the tip of the arm 9. The hydraulic cylinder 6 is an arm cylinder 6 for driving the arm 9, and the predetermined operation is a leveling operation that draws the bucket 10 along the target surface St set parallel to the ground with the tip of the bucket 10. This enables the leveling operation to be performed with high precision.

Embodiment 4

The fourth embodiment of the present invention will be described, focusing on the differences from the first embodiment. The meter-in side pressure and the meter-out side pressure of the hydraulic cylinder 5 change with the temperature of the hydraulic oil. Therefore, the controller 40 according to this embodiment executes the learning process only when the temperature of the hydraulic oil is equal to or higher than a predetermined temperature threshold.

FIG. 19 is a flowchart showing the learning process executed by the learning section 149 according to this embodiment. In FIG. 19, the difference from the first embodiment (shown in FIG. 9) is that step S401 is added after step S102.

In step S401, the learning section 149 determines whether the temperature Te of the hydraulic oil detected by the temperature sensor 19 is equal to or greater than the temperature threshold Tte. The temperature threshold Tte is stored in advance in the non-volatile memory 42. If the determination result of step S401 is NO, the process proceeds to step S102, and if the determination result is YES, the process proceeds to step S103. The determination process of step S401 is repeatedly executed at a predetermined control cycle until an positive determination is made.

In this way, in this embodiment, the conditions for starting the learning process are that the posture of the working device 1A is the learning start posture, it is the learning start target surface, it is set to the mode to execute MC, and the temperature Te of the hydraulic oil is equal to or greater than the temperature threshold Tte. In this way, by making at least the condition that the temperature Te of the hydraulic oil is equal to or greater than the temperature threshold Tte one of the conditions for starting the learning process (steps S104 to S109), it is prevented that the learning process is carried out when the temperature Te of the hydraulic oil is below the temperature threshold Tte. As a result, changes in pressure on the meter-out side due to the temperature of the hydraulic oil can be prevented, changes in learning results due to the temperature of the hydraulic oil can be suppressed, and the accuracy of area restriction control can be improved.

The working machine 1 in the fourth embodiment is equipped with a temperature sensor 19 that detects the temperature Te of the hydraulic oil, and the controller 40 calculates the correction value Pic when the temperature Te of the hydraulic oil detected by the temperature sensor 19 is equal to or greater than a predetermined threshold Tte.

According to the fourth embodiment configured as described above, changes in pressure on the meter-out side due to the temperature of the hydraulic oil can be prevented, changes in learning results due to the temperature of the hydraulic oil can be suppressed, and the accuracy of area restriction control can be improved.

Embodiment 5

The fifth embodiment of the present invention will be described, focusing on the differences from the first embodiment. The learning start target surface data stored in the learning section 149 described in the first embodiment is parallel to the X-axis of the excavator reference coordinate system of the working device 1A, and the target range in the Z-axis direction is set so that the tip of the bucket 10 operates in the air. However, an angle may be given with respect to the X-axis of the excavator reference coordinate system of the working device 1A. Note that it is the range in which the flow control valve targeted for learning operates.

Embodiment 6

The sixth embodiment of the present invention will be described, focusing on the differences from the first embodiment. FIG. 20 is a flowchart showing the learning process executed by the learning section 149 according to this embodiment. In FIG. 20, the difference from the first embodiment (shown in FIG. 9) is that steps S501 to S503 are executed instead of steps S105 and S106.

Following step S104, in step S501, the learning section 149 calculates the average value Pav of the cylinder pressure on the meter-out side measured in step S104 (hereinafter also referred to as the average cylinder pressure) and proceeds to step S502.

In step S502, the learning section 149 determines whether the average cylinder pressure Pav is equal to or greater than the lower threshold Pav1. If the determination result of step S502 is NO, the process proceeds to step S107, and if the determination result is YES, the process proceeds to step S503.

In step S503, the learning section 149 determines whether the average cylinder pressure Pav is equal to or greater than the upper threshold Pav2. If the determination result is NO, the process proceeds to step S108, and if the determination result is YES, the process proceeds to step S109.

Note that the lower threshold Pav1 and the upper threshold Pav2 are targeted at the cylinder pressure calculated theoretically based on the pre-stored opening characteristics of the flow control valve D3 and the flow passing through the flow control valve D3 during area restriction control, or the cylinder pressure determined through experiments using a prototype machine. The lower threshold Pav1 and the upper threshold Pav2 are the lower and upper limits when setting the target range (lower and upper limits) that satisfies the target value.

In this embodiment, the average cylinder pressure Pav is compared with the lower threshold Pav1 and the upper threshold Pav2 of the average cylinder pressure, and the correction value Pic of the operating pressure is obtained. By calculating the correction value Pic according to the average cylinder pressure Pav, learning processing that takes into account temporary decreases or increases in cylinder pressure, variations, etc., during the measurement of cylinder pressure can be performed. As a result, in the flow of FIG. 20, it is possible to prevent proceeding to an incorrect step.

In addition, the learning process described in the first embodiment (shown in FIG. 9) includes a step of comparing the measured cylinder pressure with the minimum threshold Pm1 and the maximum threshold Pm2 of the cylinder pressure and determining. In this embodiment, there is a step of comparing with the lower threshold Pav1 and the upper threshold Pav2 of the average cylinder pressure and determining. Any one of these, or any combination thereof, may be used, and by combining them, it is possible to prevent proceeding to an incorrect step in the flow.

The controller 40 in the sixth embodiment calculates the average value Pav of the meter-out pressure of the boom cylinder 5 measured while the working device 1A is performing a predetermined operation. The controller 40 calculates the correction value Pic so that the target operating pressure of the flow control valve D3 decreases when the average value Pav is below a predetermined second lower limit value Pav1. The controller 40 calculates the correction value so that the target operating pressure increases when the average value Pav exceeds the second upper limit value Pav2.

According to the sixth embodiment configured as described above, by calculating the correction value Pic according to the average cylinder pressure Pav, learning processing that takes into account temporary decreases or increases in cylinder pressure, variations, etc., during the measurement of cylinder pressure can be performed. As a result, in the flow of FIG. 20, it is possible to prevent proceeding to an incorrect step.

Embodiment 7

The seventh embodiment of the present invention will be described, focusing on the differences from the first embodiment. In the correction processing performed by the correction target pressure calculation section 146 according to the first embodiment, the target operating pressure PiBM3U1 corresponding to the flow control valve D3 is received by the target pressure calculation section 145, and the correction value Pic of the operating pressure obtained by the learning process by the learning section 149 is received. Then, as shown in FIG. 13, by multiplying the PiBM3U1 and the previous Pic, the correction target operating pressure PiBM3U2 is obtained. However, as shown in FIG. 21, the correction target operating pressure PiBM3U2 may be calculated by adding the correction value Pic of the operating pressure to the target operating pressure PiBM3U1. Note that, as shown in FIG. 21, when calculating the correction target operating pressure PiBM3U2 by the addition method, the initial value of the correction value Pic is set to 0.00. In S108 of FIG. 9, if it is desired to increase the command pressure, 0.01 is added to the initial value for each learning step. In S107 of FIG. 9, if it is desired to decrease the operating pressure, the initial value is subtracted by 0.01. Note that the method of correcting the target operating pressure according to the correction value Pic is not limited to multiplying or adding the correction value Pic to the target operating pressure.

Embodiment 8

The eighth embodiment of the present invention will be described, focusing on the differences from the first embodiment. The learning process described in the first embodiment becomes more accurate as the variation in the discharge flow rate of the main pumps 201, 202, and 203 corresponding to the regulator pressure with respect to the target flow rate (design value) Qc is smaller. Therefore, it is preferable to calibrate the regulator pressure with respect to the discharge flow rate of the main pumps 201, 202, and 203, and then calibrate (learn and correct) the target operating pressure with respect to the target opening area of the flow control valves D1 to D6. If the discharge flow rate of the main pumps 201, 202, and 203 varies with respect to the target flow rate (design value) Qc, the measured cylinder pressure will also vary, and it will become unclear whether the opening area corresponding to the target pressure (pressure threshold of the arm cylinder pressure) Ptaa is obtained. Therefore, in this embodiment, the learning process is performed on the flow control valves D1 to D6 after ensuring that the discharge flow rate of the main pumps 201, 202, and 203 is discharging hydraulic oil almost according to the design value. This makes it possible to improve the accuracy of the learning process.

Embodiment 9

The ninth embodiment of the present invention will be described, focusing on the differences from the above embodiment. In the above embodiments, there may be cases where hydraulic oil is supplied from one hydraulic pump to a plurality of hydraulic cylinders during the learning process. On the other hand, in MC, it is important to drive the hydraulic cylinder at the target speed, and by driving one hydraulic cylinder with one hydraulic pump (preventing diversion), the excavation accuracy is improved. Therefore, it is desirable to perform the learning process under similar conditions. Therefore, in this embodiment, when performing the learning process, the hydraulic cylinder to which hydraulic oil is supplied from one hydraulic pump is limited to one.

The working device 1A in the ninth embodiment includes a boom 8 rotatably attached to the vehicle body 1B and an arm 9 rotatably attached to the tip of the boom 8. The hydraulic cylinders 5 and 6 that drive the working device 1A include a boom cylinder 5 that drives the boom 8 and an arm cylinder 6 that drives the arm 9. The hydraulic pumps 202 and 203 include a variable capacity type first hydraulic pump 203 that preferentially supplies hydraulic oil to the boom cylinder 5 and a variable capacity type second hydraulic pump 202 that preferentially supplies hydraulic oil to the arm cylinder 6. The flow control valves D3 and D4 include a first flow control valve D3 that controls the flow rate of hydraulic oil supplied from the first hydraulic pump 203 to the boom cylinder 5 and a second flow control valve D4 that controls the flow rate of hydraulic oil supplied from the second hydraulic pump 202 to the arm cylinder 6. The solenoid valves 5*a* to 57*b* include a first solenoid valve 56*a*, 56*b* that generates the operating pressure of the first flow control valve D3 and a second solenoid valve 57*a*, 57*b* that generates the operating pressure of the second flow control valve D4. The controller 40 calculates the correction value Pic of the target operating pressure of the first solenoid valve 56*a*, 56*b* using the meter-out pressure of the boom cylinder 5 measured while the working device 1A is performing an operation that drives only the first flow control valve D3. Additionally, the controller 40 calculates the correction value Pica for the target operating pressure of the second solenoid valves 57*a*, 57*b* using the meter-out pressure of the arm cylinder 6 measured while the operation of driving only the second flow control valve D4 is performed on the working device 1A.

According to the ninth embodiment configured as described above, by calculating the correction values Pic and Pica for the operation of driving one hydraulic cylinder with one hydraulic pump, the accuracy of the area restriction control can be improved.

While the embodiments of the present invention have been described in detail, the invention is not limited to the above embodiments and includes various modifications. For example, the above-described embodiments have been detailed to clearly explain the present invention, and the invention is not necessarily limited to including all the configurations described. Additionally, it is possible to add parts of the configuration of one embodiment to another embodiment, or to delete parts of the configuration of one embodiment and replace them with parts of another embodiment.

DESCRIPTION OF REFERENCE CHARACTERS

1 . . . Hydraulic excavator (work machine), 1A . . . Working device, 1B . . . Vehicle body, 5 . . . Boom cylinder (hydraulic cylinder), 5*a*, 5*b* . . . Pressure sensor, 6 . . . Arm cylinder (hydraulic cylinder), 6*a*, 6*b* . . . Pressure sensor, 7 . . . Bucket cylinder, 7*a*, 7*b* . . . Pressure sensor, 8 . . . Boom, 9 . . . Arm, 10 . . . Bucket, 11 . . . Traveling body, 12 . . . Swing body, 13 . . . Bucket link, 14 . . . Vehicle body position detection device, 14*a* . . . GNSS antenna, 14*b* . . . GNSS antenna, 15 . . . Control valve unit, 16 . . . . Operating room, 18 . . . Engine, 19 . . . Temperature sensor, 21 . . . Control system, 30 . . . Boom angle sensor, 31 . . . Arm angle sensor, 32 . . . Bucket angle sensor, 33 . . . Vehicle body inclination angle sensor, 39 . . . Lock valve, 40 . . . Controller, 41 . . . Processing device, 42 . . . Non-volatile memory, 43 . . . Volatile memory, 44 . . . Input interface, 45 . . . Output interface, 48 . . . Pilot pump, 50 . . . Posture detection device, 51 . . . Target surface setting device, 53 . . . Display device, 53*a* . . . Learning start posture screen, 55*a*, 55*b* . . . Solenoid valve, 56*a*, 56*b* . . . Solenoid valve (first solenoid valve), 57*a*, 57*b* . . . Solenoid valve (second solenoid valve), 58*a*, 58*b*, 59*a*, 59*b* . . . Solenoid valve, 91 . . . Boom pin, 92 . . . Arm pin, 93 . . . Bucket pin, 96 . . . External input device, 141 . . . Operation amount calculation section, 142 . . . Posture calculation section, 143 . . . Target surface calculation section, 144 . . . Target speed calculation section, 145 . . . Target pressure calculation section, 146 . . . Correction target pressure calculation section, 147 . . . Valve command calculation section, 148 . . . Solenoid valve control section, 149 . . . Learning section, 150 . . . Display control section, 170 . . . Discharge piping, 201 . . . First main pump, 201*a* . . . Regulator, 201*b* . . . Pressure sensor, 202 . . . Second main pump (second hydraulic pump), 202*a* . . . Regulator, 202*b* . . . Pressure sensor, 203 . . . Third main pump (first hydraulic pump), 203*a* . . . Regulator, 203*b* . . . Pressure sensor, A1 to A3 . . . Electric operation lever device, B1, B2 . . . Operation lever, C1 to C12 . . . Pilot line, D1, D2 . . . Flow control valve, D3 . . . Flow control valve (first flow control valve), D4 . . . Flow control valve (second flow control valve), D5, D6 . . . Flow control valve, E1 to E12 . . . Pressure receiving chamber, St . . . Excavation target surface, To . . . Opening characteristic table.

The invention claimed is:

1. A work machine comprising:

a vehicle body;

a working device rotatably attached to the vehicle body;

a hydraulic cylinder for driving the working device;

an operating device for operating the working device;

a hydraulic pump;

a flow control valve for controlling a flow rate of a hydraulic oil supplied from the hydraulic pump to the hydraulic cylinder;

a solenoid valve for generating an operating pressure of the flow control valve; and a controller that calculates a target speed of the hydraulic cylinder based on an operating variable of the operating device so that an operating range of the working device is limited to a target surface and above, calculates a target operating pressure of the flow control valve based on the target speed, and controls the solenoid valve according to the target operating pressure, wherein the work machine further includes a pressure sensor for measuring a meter-out pressure of the hydraulic cylinder, and the controller calculates a correction value of the target operating pressure to keep the measured meter-out pressure within a range from a predetermined first lower limit value to a predetermined first upper limit value while driving the hydraulic cylinder to perform a predetermined operation on the working device, and corrects the target operating pressure according to the correction value.

2. The work machine according to claim 1, wherein the controller calculates the correction value so that the target operating pressure decreases if a minimum value of the meter-out pressure measured while performing the predetermined operation on the working device is below the first lower limit value;

the controller calculates the correction value so that the target operating pressure increases if a maximum value of the meter-out pressure measured while performing the predetermined operation on the working device exceeds the first upper limit value; and the controller corrects the target operating pressure by increasing or decreasing it according to the correction value.

3. The work machine according to claim 1, wherein the controller calculates an average value of the meter-out pressure measured while performing the predetermined operation on the working device; and the controller calculates the correction value so that the target operating pressure decreases if the average value is below a predetermined second lower limit value, and calculates the correction value so that the target operating pressure increases if the average value exceeds a predetermined second upper limit value.

4. The work machine according to claim 1, wherein the pressure sensor detects a meter-in pressure of the hydraulic cylinder, and the controller calculates a measured value of the meter-out pressure by multiplying the meter-in pressure detected by the pressure sensor by a pressure receiving area ratio of the hydraulic cylinder.

5. The work machine according to claim 1, wherein the work machine further includes a temperature sensor for detecting a temperature of the hydraulic oil, and the controller calculates the correction value when the temperature of the hydraulic oil detected by the temperature sensor is equal to or higher than a predetermined threshold.

6. The work machine according to claim 1, wherein the working device includes a boom rotatably attached to the vehicle body, an arm rotatably attached to a distal end of the boom, and a bucket rotatably attached to a distal end of the arm;

the hydraulic cylinder is a boom cylinder for driving the boom or an arm cylinder for driving the arm;

the predetermined operation is a leveling operation that draws the bucket along the target surface set parallel to a ground with a tip of the bucket.

7. The work machine according to claim 1, wherein the working device includes a boom rotatably attached to the vehicle body, an arm rotatably attached to a distal end of the boom, and a bucket rotatably attached to a distal end of the arm;

the hydraulic cylinder is a boom cylinder for driving the boom;

the predetermined operation is a boom raise operation that raises the boom without operating the arm or the bucket.

8. The work machine according to claim 1, wherein the working device includes a boom rotatably attached to the vehicle body and an arm rotatably attached to a distal end of the boom;

the hydraulic cylinder includes a boom cylinder for driving the boom and an arm cylinder for driving the arm;

the hydraulic pump includes a variable capacity first hydraulic pump that preferentially supplies the hydraulic oil to the boom cylinder and a variable capacity second hydraulic pump that preferentially supplies the hydraulic oil to the arm cylinder;

the flow control valve includes a first flow control valve that controls the flow rate of the hydraulic oil supplied from the first hydraulic pump to the boom cylinder and a second flow control valve that controls the flow rate of the hydraulic oil supplied from the second hydraulic pump to the arm cylinder;

the solenoid valve includes a first solenoid valve that generates the operating pressure of the first flow control valve and a second solenoid valve that generates the operating pressure of the second flow control valve;

the controller calculates the correction value of the target operating pressure of the first solenoid valve when the predetermined operation is an operation that drives only the first flow control valve, and calculates the correction value of the target operating pressure of the second solenoid valve when the predetermined operation is an operation that drives only the second flow control valve.

* * * * *